US007988504B2

(12) United States Patent
Stromiedel

(10) Patent No.: US 7,988,504 B2
(45) Date of Patent: Aug. 2, 2011

(54) PLUG CONNECTOR

(75) Inventor: Konrad Stromiedel, Wolkramshausen (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 12/843,206

(22) Filed: Jul. 26, 2010

(65) Prior Publication Data

US 2011/0028050 A1 Feb. 3, 2011

(30) Foreign Application Priority Data

Jul. 31, 2009 (DE) ..... 10 2009 035 716

(51) Int. Cl.
*H01R 13/50* (2006.01)

(52) U.S. Cl. ..... 439/809; 439/709

(58) Field of Classification Search ..... 439/809, 439/709

See application file for complete search history.

(56) References Cited

U.S. PATENT DOCUMENTS

| | | | | |
|---|---|---|---|---|
| 4,060,305 | A * | 11/1977 | Poliak et al. | 439/625 |
| 4,632,491 | A * | 12/1986 | Lutz | 439/650 |
| 7,704,095 | B2 | 4/2010 | Stromiedel | |
| 7,845,970 | B2 | 12/2010 | Stromiedel | |

FOREIGN PATENT DOCUMENTS

| | | |
|---|---|---|
| DE | 10 2007 018 443 | 11/2007 |
| EP | 1 152 489 | 11/2001 |
| EP | 1 622 224 | 2/2006 |
| FR | 2 164 027 | 7/1973 |
| FR | 2 205 759 | 5/1974 |
| WO | WO 00/31830 | 6/2000 |

* cited by examiner

*Primary Examiner* — Gary F. Paumen
(74) *Attorney, Agent, or Firm* — Whitham Curtis Christofferson & Cook, PC

(57) ABSTRACT

The plug connector has a housing made of insulating material which includes an opening on one face for insertion of conductive contact pins and another opening on another face for insertion of the stripped ends of electrical conductors. There is a spring force terminal connection in each conductor connection area which pushes the stripped end of a conductor toward the contact pin insertion opening. The width (B1) of a passage for a contact pin is less than the width (B2) in the contact area adjacent to the contact pin insertion opening. The stripped end of the electrical conductor makes contact at a conductor contact section and can be moved against the spring force of an associated spring element.

17 Claims, 25 Drawing Sheets

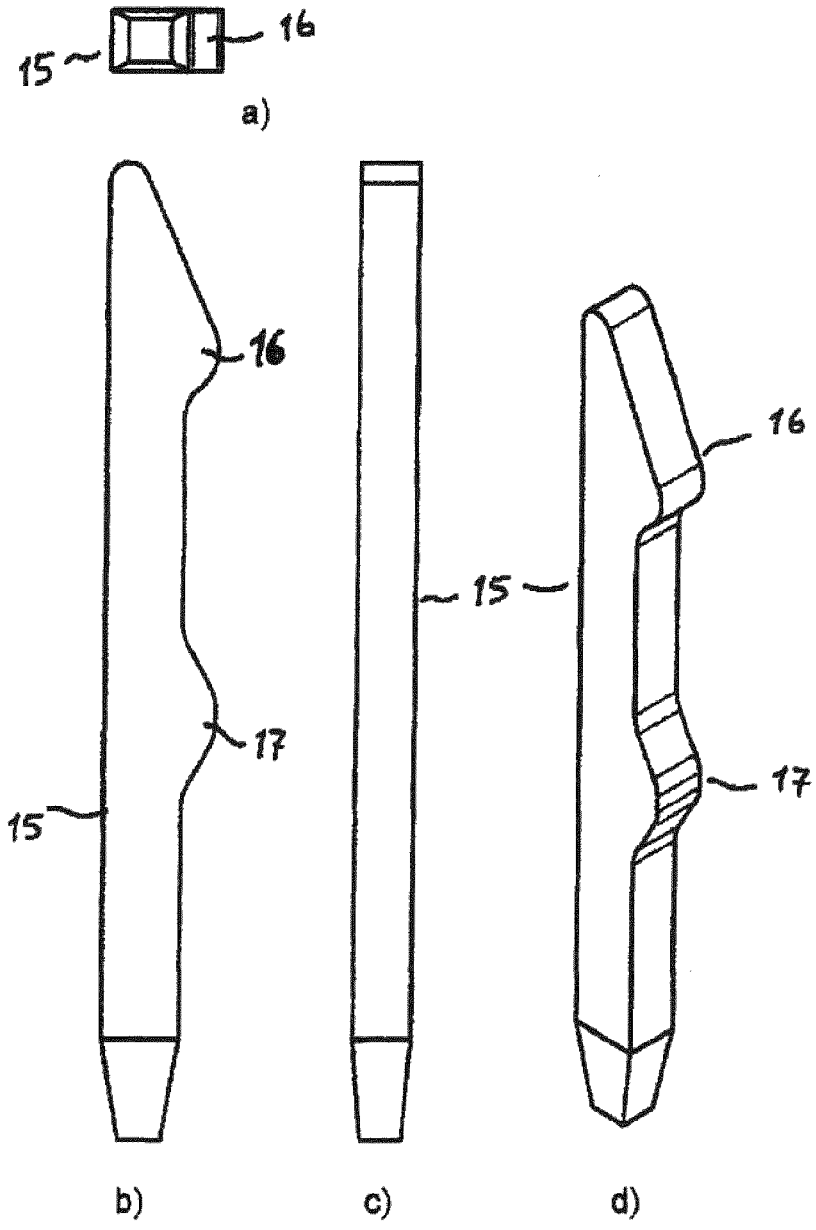
Fig. 10)

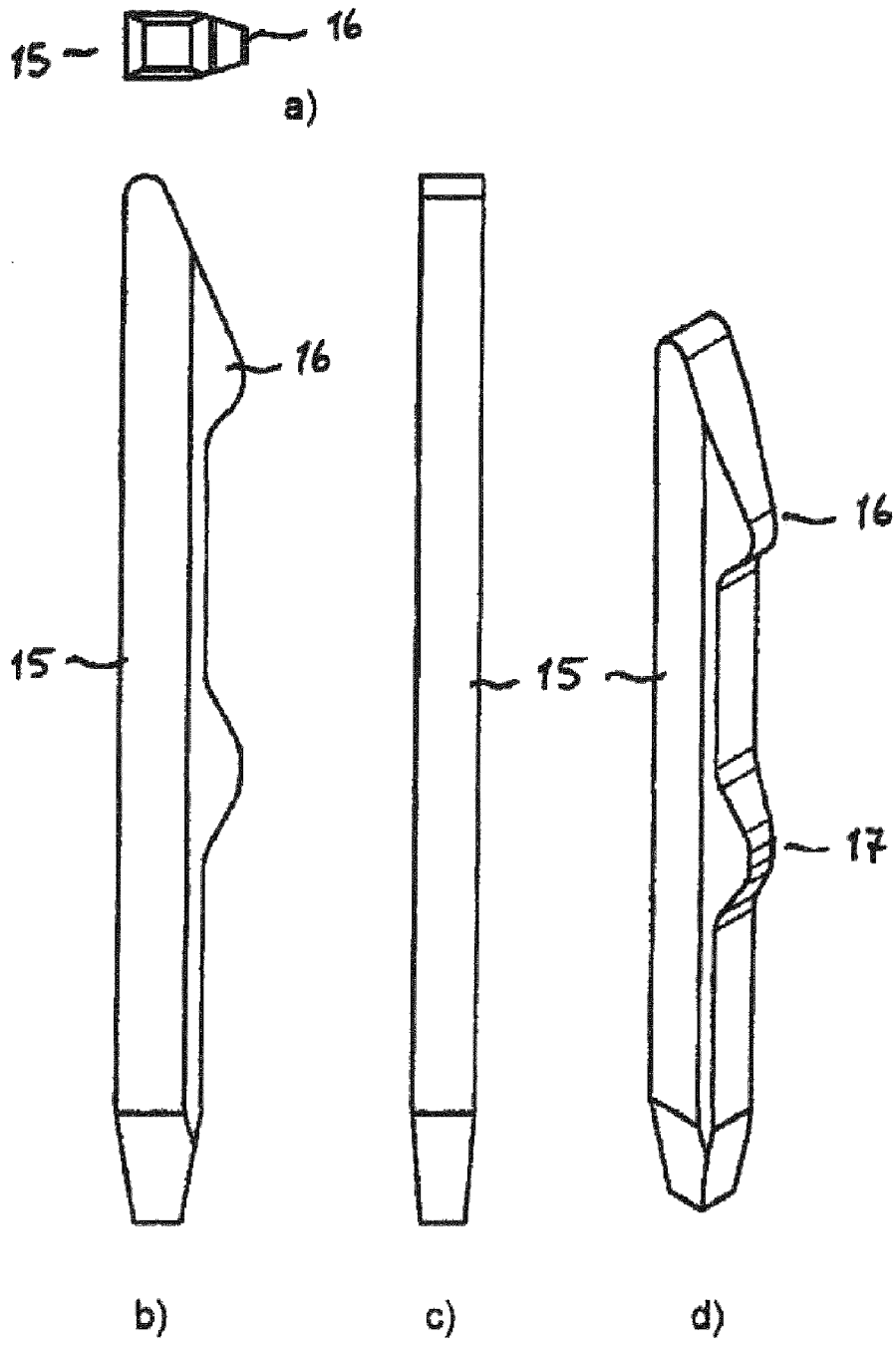
Fig. 11)

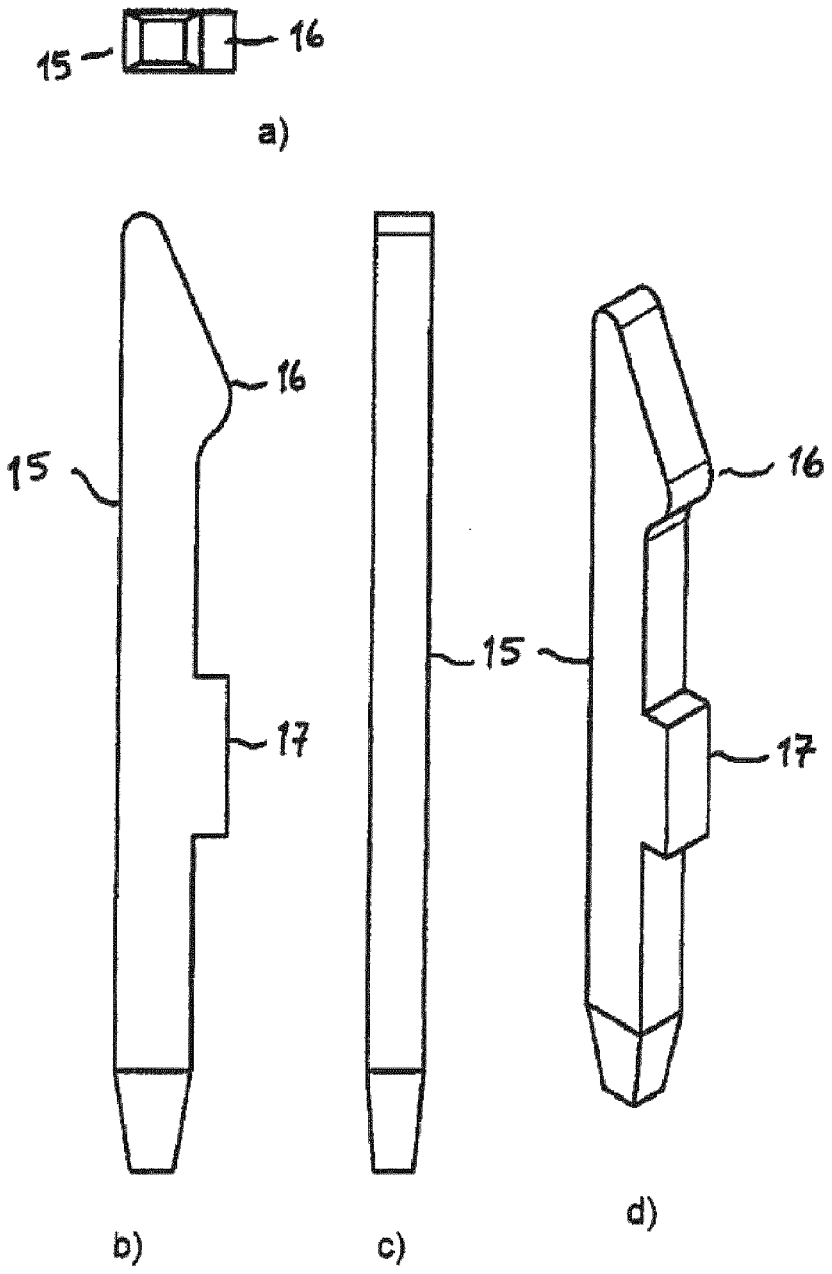
Fig. 12)

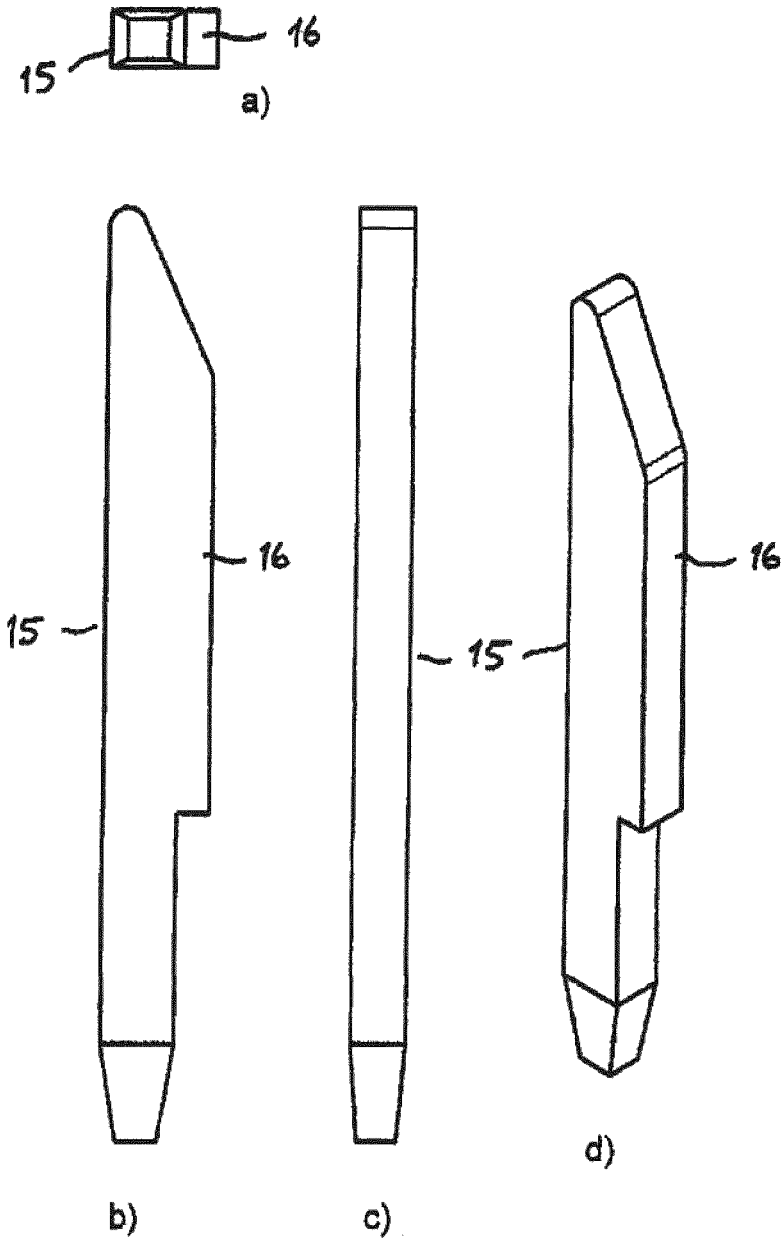
Fig. 13)

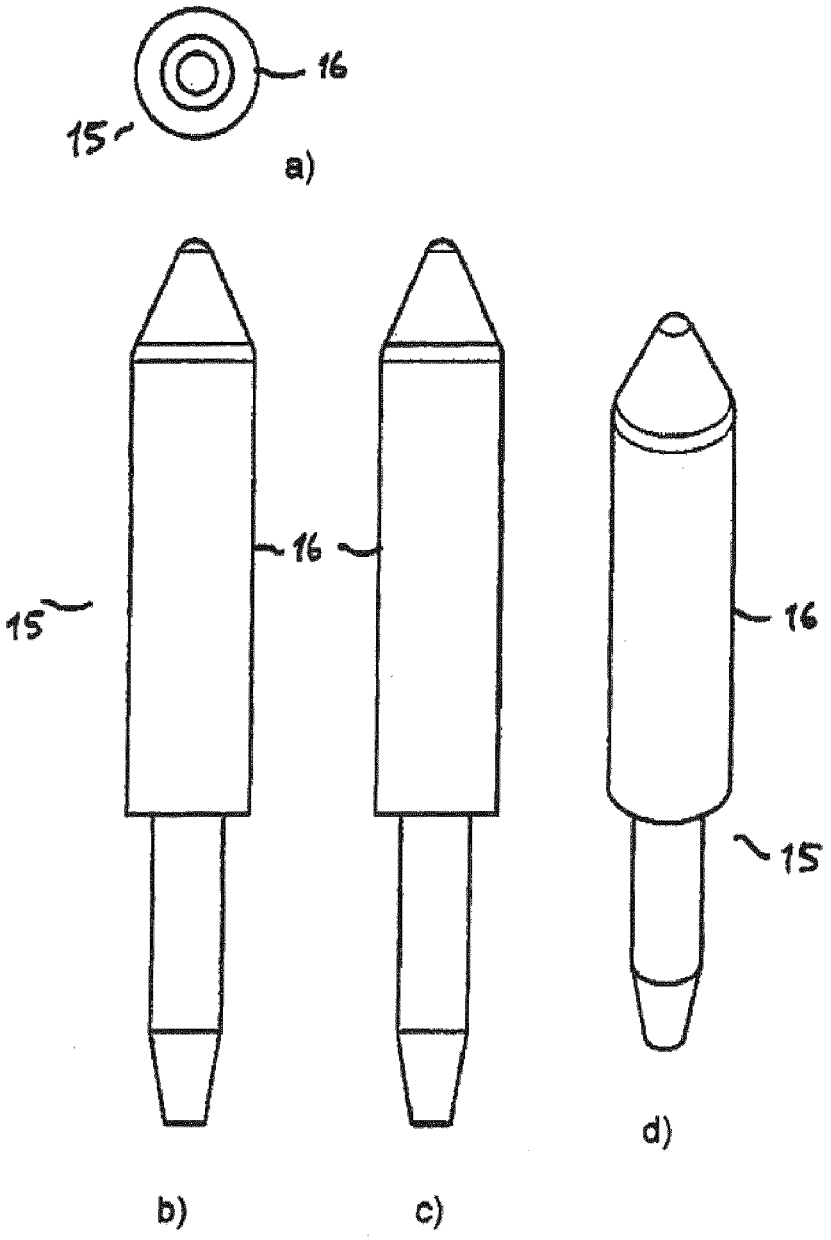
Fig. 14)

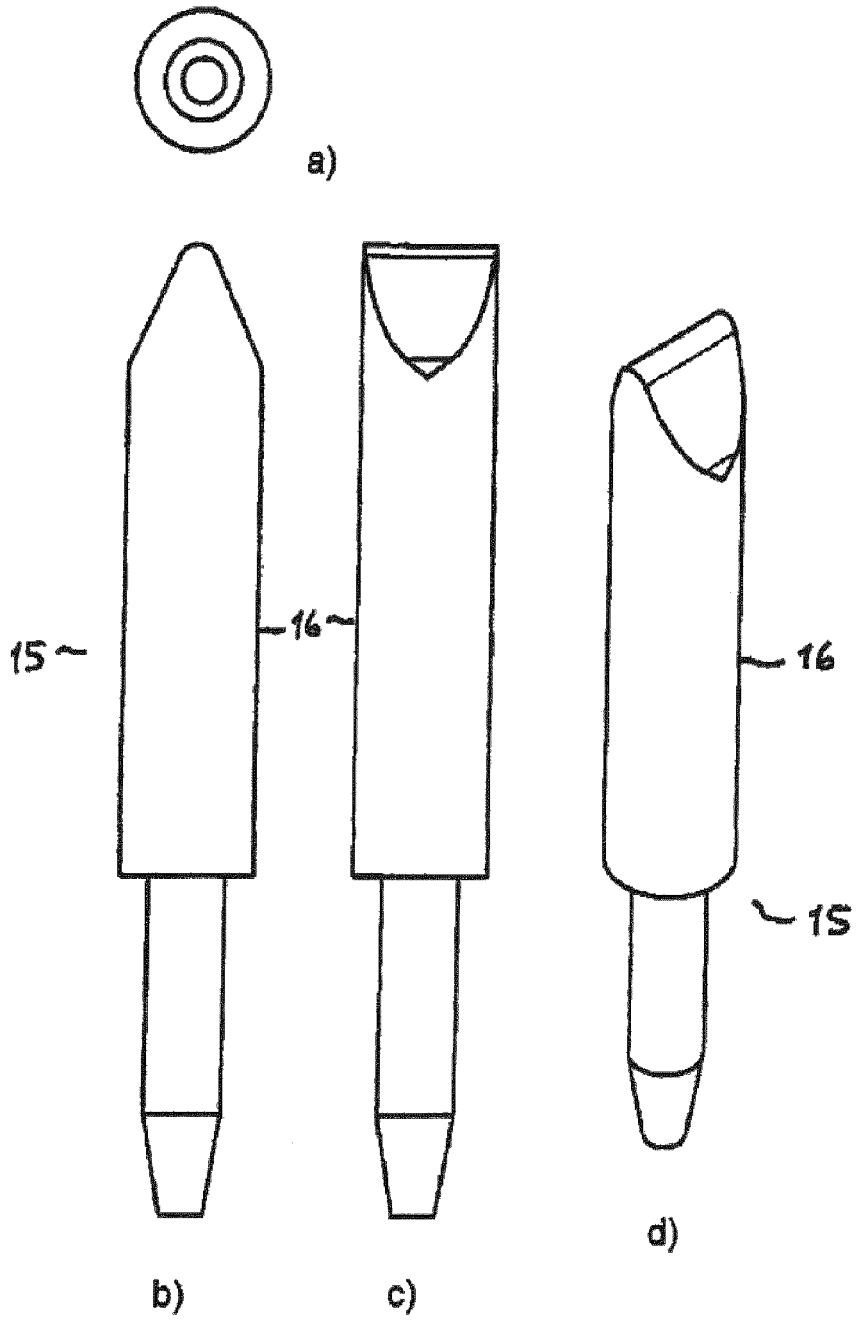
Fig. 15)

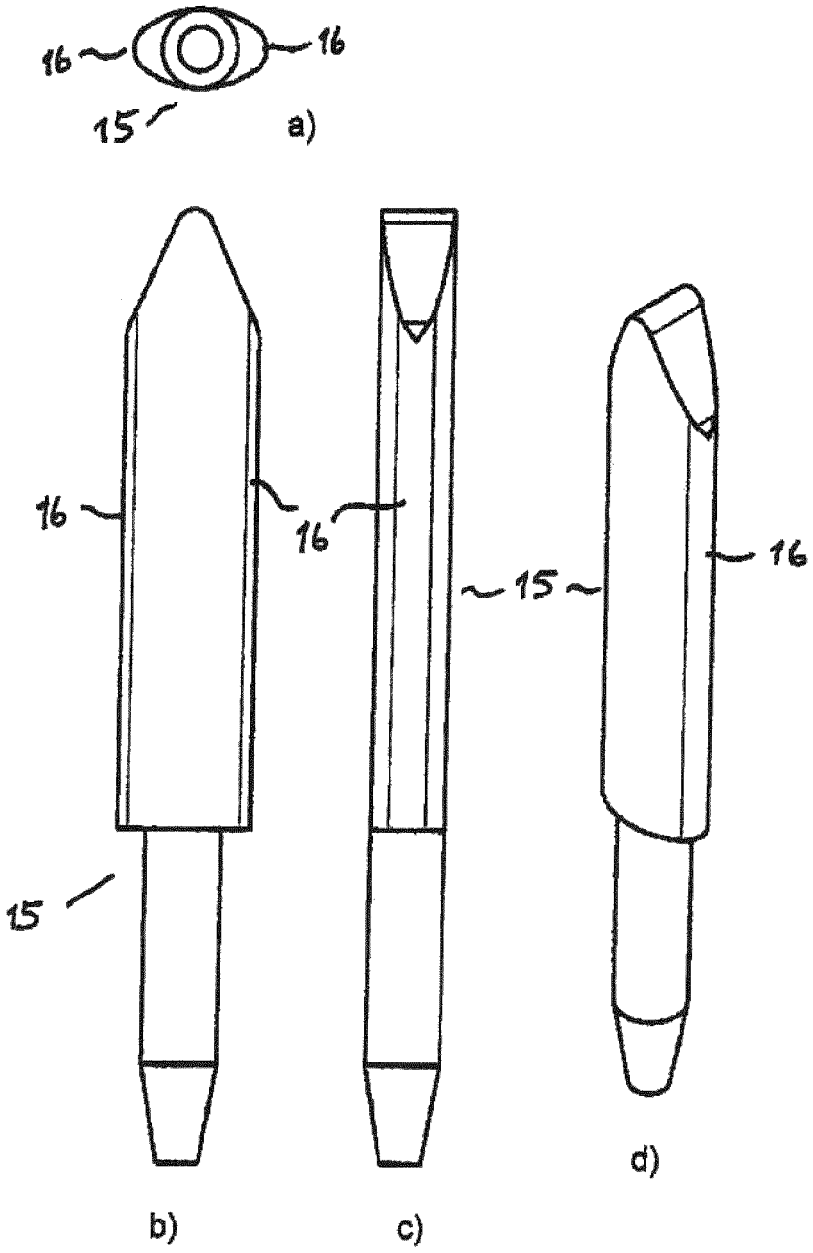
Fig. 16)

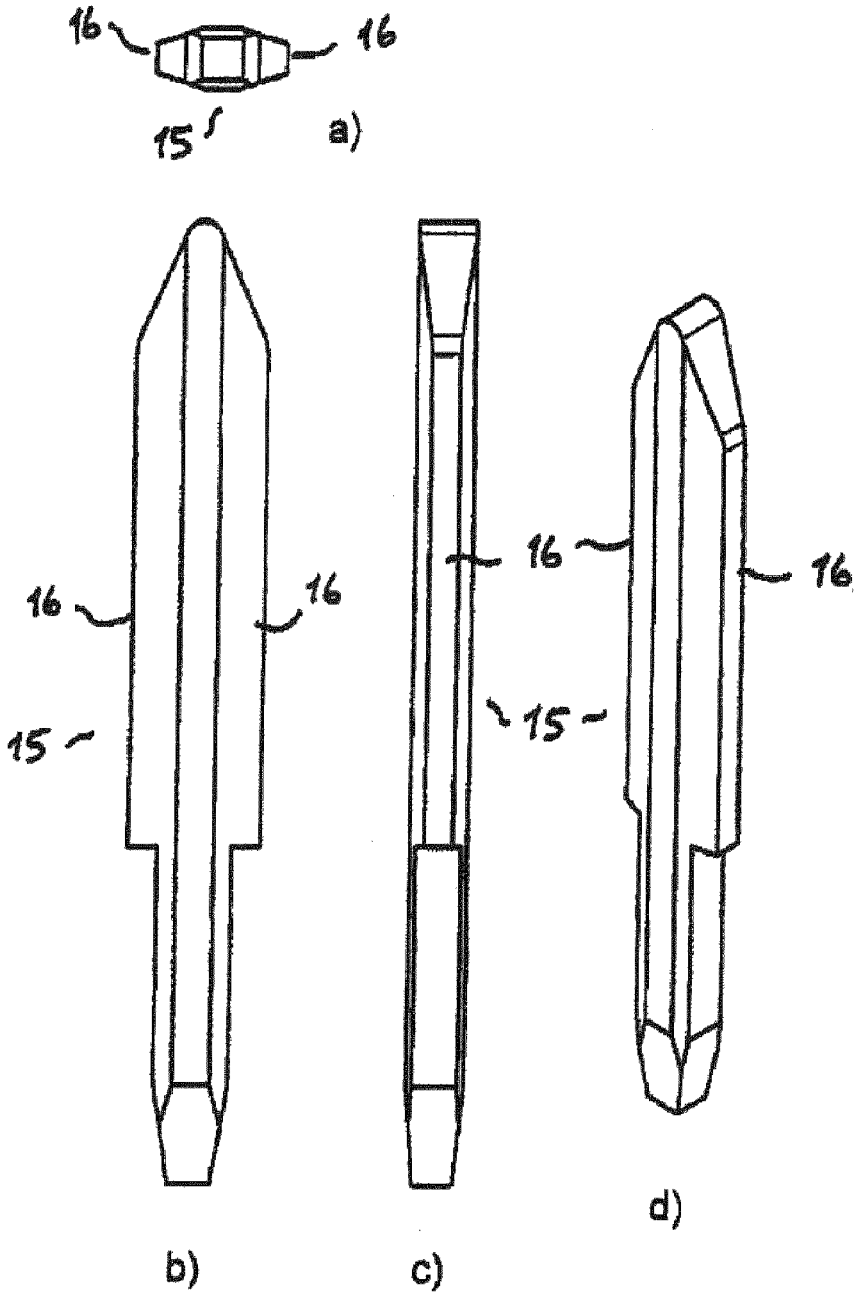
Fig. 17)

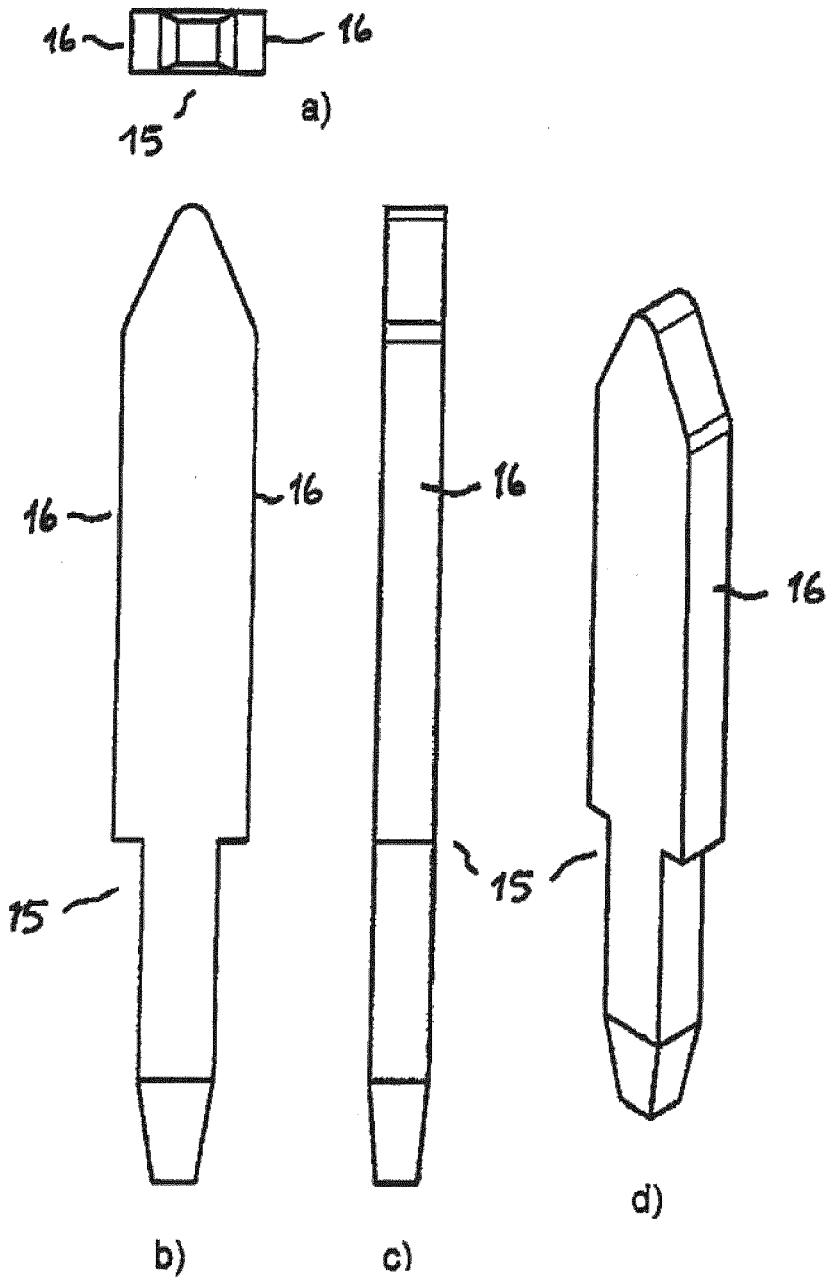
Fig. 18)

PLUG CONNECTOR

BACKGROUND DESCRIPTION

The invention relates to a plug connector having an insulating material housing which has at least one contact pin insertion opening on a first housing face for the insertion of electrically conductive contact pins, and has at least one conductor insertion opening on a second housing face for the insertion of stripped ends of electrical conductors. A pair comprising a contact pin insertion opening and a conductor insertion opening are each associated with one common conductor connecting area. The conductor insertion opening opens in the conductor connecting area and the contact pin insertion opening has a passage to the conductor connecting area, and having in each case one spring force terminal connection in an associated conductor connecting area with a spring element which has a clamping section, which can be moved by spring force transversely with respect to the extent direction of a pair comprising a contact pin insertion opening and a conductor insertion opening, such that, when a stripped end of an electrical conductor is inserted into the conductor insertion opening, the stripped end is pushed in the direction of the contact pin insertion opening.

Plug connectors such as these are used in order to make contact between electrical conductors and the plug connector with the aid of a spring force terminal connection, without the use of screws, and to make electrical contact with a contact pin via the spring force terminal connection. By way of example, the contact pin can be soldered into a printed circuit board, or can provide a connection to a mating plug connector fitted to the plug connector.

WO 00/31830 discloses a plug connector such as this in the form of a printed circuit board connecting terminal. An electrical conductor is in this case pushed onto a contact pin, which can be soldered into a printed circuit board, with the aid of a contact spring, thus producing an electrically conductive contact between an electrical conductor and a contact pin. The lower edge of the conductor insertion opening is aligned with the upper edge of the contact pin. Since the contact pin is intended to be fitted into the housing before the insertion of the electrical conductor, the contact pin and the electrical conductor share a common conductor connecting area. Otherwise, the electrical conductor would be pushed into the accommodation area for the contact pin by the spring force and would close this such that no contact pin can subsequently be inserted into the plug connector after an electrical conductor has been inserted.

DE 10 2007 018 443 A1 discloses a plug connector of this generic type in which the electrical conductor can be moved, preferably parallel, transversely with respect to its conductor axis in a movement range which is permitted by the design. In this case, the leafspring end of the leafspring terminal connection should rest on that side of the electrical conductor which is opposite the contact pin. This results in the clamping force of the leafspring pushing the electrical conductor in the direction of the contact pin. The movement range is in this case provided above the clamping point, in the area of the conductor insertion opening in the insulating material housing, and forms part of the conductor insertion opening, such that, when seen in cross section, the conductor insertion opening together with the movement range are located at the same height as the movement range on an axis of symmetry of the conductor insertion opening which is defined by the conductor insertion opening above the movement range. Under the movement range, the conductor connecting area and the contact pin insertion opening merge into one another such that the electrical conductor is pushed by a spring force into the contact pin insertion opening when no contact pin has been inserted into the plug connector.

SUMMARY OF THE INVENTION

The object of the present invention is to provide an improved plug connector in which the contact pin insertion opening is kept free of a clamped-in electrical conductor when the contact pin is unplugged and in which, nevertheless, adequate movement of the electrical conductor is achieved against the spring force during insertion of a contact pin and, associated with this, reliable electrical contact is achieved between the electrical conductor and the contact pin.

The object is achieved by the plug connector of the type mentioned initially in that the at least one contact pin insertion opening has a width of the passage over a length in its extent direction, which is aligned from the first housing face to the second housing face, at least in the area above the clamping section in the direction of the second housing face and under the clamping section in the direction of the first housing face, which width is less than the width between the mutually opposite side walls of the conductor connecting area adjacent to the transition to the contact pin insertion opening.

The reduced width of the passage of the contact pin insertion opening to the conductor connecting area leads to physical separation of the conductor connecting area and contact pin insertion opening, and prevents the stripped end of an electrical conductor being pushed into the contact pin insertion opening by the spring element such that the contact pin insertion opening is blocked, preventing a contact pin from being inserted into the contact pin insertion opening. The passage of the contact pin insertion opening to the conductor connecting area is also used as a movement range for the electrical conductor, which can partially enter this passage, in order to push the electrical conductor back against the spring force, in the direction of the conductor connecting area, after insertion of a contact pin. This ensures a reliable electrical contact between the contact pin and the stripped end of the electrical conductor. The stripped end of the electrical conductor is in this case pushed against the contact pin by the spring element.

In order to keep the contact pin insertion opening free, and in order to allow the stripped end of the electrical conductor to be moved by the contact pin in the direction of the conductor connecting area in order to make reliable contact, it is essential that the electrical conductor not be movable against the spring force in the area of the conductor insertion opening, in the same way as conventionally in the conductor insertion opening, but that it can enter the passage of the contact pin insertion opening. It is therefore proposed to provide a passage with a reduced diameter, that is to say a reduced passage width, in the contact pin insertion opening adjacent to the transition to the conductor connecting area in the insulating material housing.

The passage should preferably be located completely outside the conductor insertion opening contour at the transition to the conductor connecting area.

Plug connectors normally have a defined minimum permissible nominal cross section of an electrical conductor and a defined maximum permissible nominal cross section. It is advantageous for the width of the passage of the contact pin insertion direction, which passage leads to the conductor connecting area, is matched to the minimum permissible nominal cross section of the electrical conductor, which nominal cross section is defined for the plug connector, such that the stripped end enters the passage, leaving a free space for a contact pin with a part of its cross section, when no contact pin is inserted. The passage is matched to the contact pin such that a conductor contact section facing the conductor connecting area of the contact pin enters the passage, and in the process the stripped end of the electrical conductor makes contact with the conductor contact section and is moved against the spring force of the associated spring, element.

The passage therefore has at least one area with a passage width which is less than the minimum permissible nominal cross section of the electrical conductor, that is to say the minimum permissible diameter of the stripped end of an electrical conductor. This prevents the stripped end of the electrical conductor from blocking the contact pin insertion opening when no contact pin is inserted. In contrast, the contact pin is itself shaped such that it can be plugged into the contact pin insertion opening, with the stripped end of the electrical conductor being moved against the spring force, and, in the process, the stripped end of the electrical conductor makes contact with its conductor contact section.

By way of example, the conductor contact section of the contact pin may be a protrusion, but its width is matched to the minimum passage width of the passage, which depends on the minimum permissible nominal cross section of the electrical conductor, in order to allow it to at least partially enter this passage.

It is particularly advantageous for the contact pin insertion opening not to have a constant width, which is less than the width of the conductor connecting area, over its entire depth, but for the passage of the contact pin insertion opening to the conductor connecting area to have an area with a passage width which decreases from the conductor connecting area in the direction of the contact pin insertion opening. This allows the stripped end of the electrical conductor to enter the passage of the contact pin insertion opening relatively far, without blocking it. This is because the contact pin insertion opening is kept free by the minimum passage width, which is arranged at a distance from the conductor connecting area because of the contour which tapers toward the contact pin insertion opening.

By way of example, adjacent to the conductor connecting area, the passage can have an area whose cross section tapers in the form of part of a circle, such that the passage of the contact pin insertion opening creates a movement area which is located off the plane of symmetry of the conductor insertion opening, into which a part of an electrical conductor, which conventionally has a circular cross section, can enter.

In this case, it is advantageous for the radius of that area of the passage which has a circular cross section to be matched to a defined nominal cross section of an electrical conductor for the plug connector, and preferably to correspond thereto.

It is also advantageous for the passage of the at least one contact pin insertion opening to have an area which tapers from the contact pin insertion opening in the direction of the conductor connecting area. The taper may be continuous (for example conical) or discontinuous (for example with a step). The contour of the contact pin should then likewise be matched to the tapered shape of the passage, such that the contact section of the contact pin for the stripped end of the electrical conductor is narrower than the contact pin in the area of the contact pin insertion opening outside the passage. This therefore achieves adequate guidance for the contact pin during insertion of the contact pin, as a result of which it can be inserted only in a defined manner. At the same time, this results in a defined narrow contact area and in the contact force being concentrated on this narrow contact area. This results in high contact reliability and reduced contact resistance.

In one optional embodiment of a double-pole plug connector, a contact pin insertion opening is associated with two mutually opposite conductor insertion openings which open into a respective conductor connecting area. The associated contact pin insertion opening has two mutually opposite passages, which open into a respective conductor insertion opening. Two electrical conductors can therefore be inserted into one respective conductor insertion opening, and can make contact with a common contact pin. In this case, the contact pin insertion opening is positioned centrally between the two mutually opposite conductor connecting areas and conductor insertion openings.

It is advantageous if in the area of the at least one contact pin insertion opening, the insulating material housing in each case has an insulating material overhang for fixing the position of the head end of a contact pin which has been inserted into the contact pin insertion opening. This allows the contact pin to be guided in the contact pin insertion opening with the aid of the insulating material overhang, and to be held at a defined position.

It is particularly advantageous if in the unstressed state when no electrical conductor has been inserted into the associated conductor insertion opening, the clamping end of the spring element does not project into the contact pin insertion opening. This reduces the insertion depth of an electrical conductor into the passage and also prevents the contact pin insertion opening from being blocked by the stripped end of the electrical conductor. In this context, it is advantageous if in the unstressed state when no electrical conductor has been inserted into the associated conductor insertion opening, the clamping end of the spring element abuts against a lateral wall of the conductor connecting area adjacent to the contact pin insertion opening.

All the abovementioned embodiments of plug connectors may also additionally have an intermediate wall which can be moved into the passage, for example by movement or tilting, and which is intended for positioning between the contact pin and the stripped end of the electrical conductor. The intermediate wall should extend at least over the area of the clamping point in which the stripped end of the electrical conductor overlaps the conductor contact section of the contact pin. However, the intermediate wall preferably extends over the entire length of the passage to the conductor connecting area in a direction from a first housing face to the second housing face.

The intermediate wall is advantageous because it reliably prevents wires of multiwire flexible electrical conductors from entering the contact pin insertion opening, and guides the electrical conductor into the conductor connecting area, in the direction of its conductor axis, during the insertion process. This guidance by means of the intermediate wall prevents individual wires of a multiwire flexible conductor from undesirably becoming unraveled.

The upper or lower end, for example, of the intermediate wall can be mounted in the insulating material housing such that it can pivot into the passage. However, it is also feasible for the intermediate wall to have guides, which are mounted such that it can be moved, preferably parallel in the direction of the conductor connecting area, in the contact pin insertion opening, in or on the wall of the insulating material housing. It is also feasible for the intermediate wall to have stops, for example formed by folded-over side edges, which interact with lateral walls of the conductor connecting area, which are adjacent to the passage, and form a stop in order to limit the movement of the intermediate wall into the contact pin insertion opening. In the position in which they have been very largely inserted into the contact pin insertion opening, the stops in this case rest on the lateral wall, and prevent the intermediate wall from entering any further into the contact pin insertion opening.

BRIEF DESCRIPTION OF THE DRAWINGS

The invention will be explained in more detail in the following text with reference to exemplary embodiments and attached drawings, in which:

FIG. 1 *b*) shows a detail view of the plug connector in FIG. 1 *a*) in the spring clamping area;

FIG. 1 *c*) shows a plan section view of the plug connector shown in FIG. 1 *a*);

FIG. 1 *d*) shows a plan section view of the plug connector shown in FIG. 1 *a*) with an intermediate wall;

FIG. 1 *e*) shows a side section view of the plug connector with an intermediate wall;

FIG. 1 *f*) shows a plan section view of a modified plug connector as shown in FIG. 1 *a*) with a constant passage width;

FIG. 2 *b*) shows a detail view of the plug connector from FIG. 2 *a*);

FIG. 2 *c*) shows a plan section view of the plug connector shown in FIG. 2 *a*) with an inserted conductor;

FIG. 3 *b*) shows a detail view of the plug connector shown in FIG. 3 *a*);

FIG. 3 *c*) shows a plan section view of the plug connector shown in FIG. 3 *a*) with an inserted conductor and contact pin;

FIG. 4 *b*) shows a detail view of the plug connector shown in FIG. 4 *a*);

FIG. 4 *c*) shows a plan section view of the plug connector shown in FIG. 4 *a*);

FIG. 7 *b*) shows a plan section view of the plug connector, in the detail shown in FIG. 7 *a*);

FIG. 8 *b*) shows a detail view of the plug connector shown in FIG. 7 *a*) with an inserted conductor and contact pin;

FIG. 8 *c*) shows a plan section view of the plug connector shown in FIG. 8 *a*);

FIG. 9 *b*) shows a plan section view of the plug connector shown in FIG. 8 *a*) with a conductor inserted;

FIG. 10) shows views of a first embodiment of a contact pin with a protrusion, in the form of a plan view, side view, rear view and perspective view;

FIG. 11) shows views of a second embodiment of a contact pin with a protrusion, in the form of a plan view, side view, rear view and perspective view;

FIG. 12) shows views of a third embodiment of a contact pin with a protrusion, in the form of a plan view, side view, rear view and perspective view;

FIG. 13) shows views of a fourth embodiment of a contact pin, in the form of a plan view, side view, rear view and perspective view;

FIG. 14) shows views of a fifth embodiment of a contact pin with a conical point, in the form of a plan view, side view, rear view and perspective view, FIG. 15) shows views of a sixth embodiment of a contact pin, in the form of a plan view, side view, rear view and perspective view, FIG. 16) shows views of a seventh embodiment of a contact pin, in the form of a plan view, side view, rear view and perspective view, FIG. 17) shows views of a eighth embodiment of a contact pin, in the form of a plan view, side view, rear view and perspective view, FIG. 18) shows views of a ninth embodiment of a contact pin, in the form of a plan view, side view, rear view and perspective view.

DETAILED DESCRIPTION OF A PREFERRED EMBODIMENTS OF THE INVENTION

Figure 1:
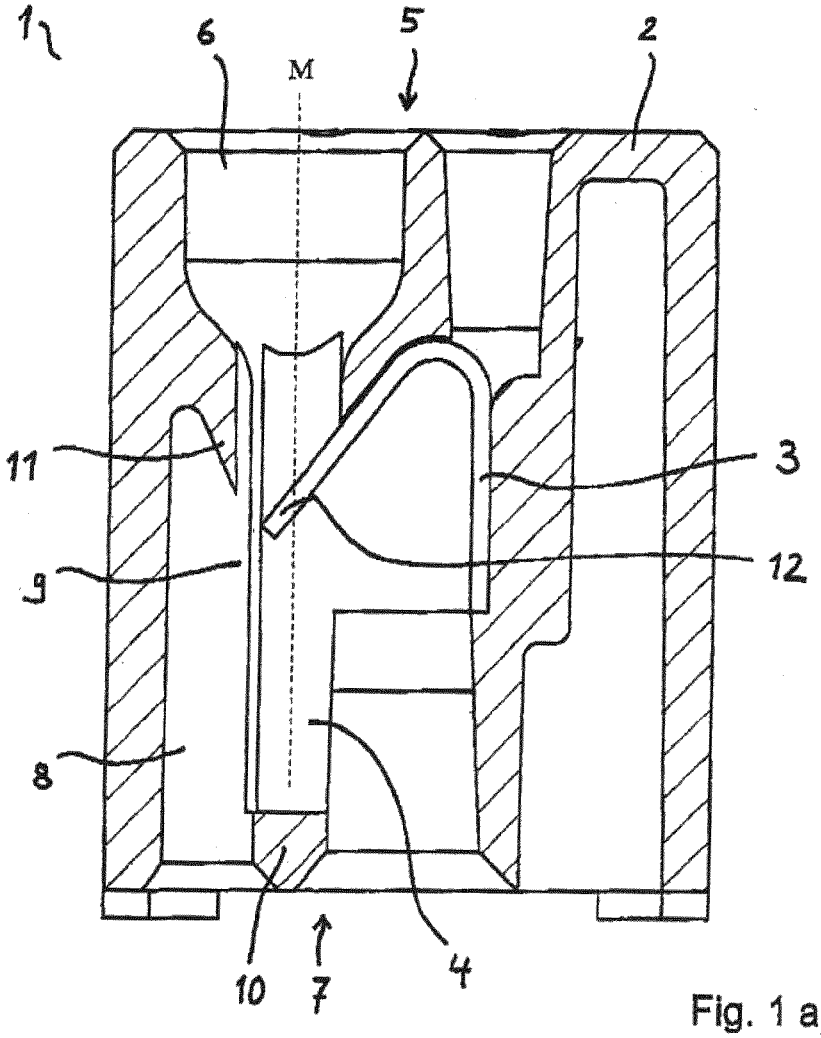
FIG. 1 *a*) shows a side section view of a first embodiment of a plug connector.
Figure 1:
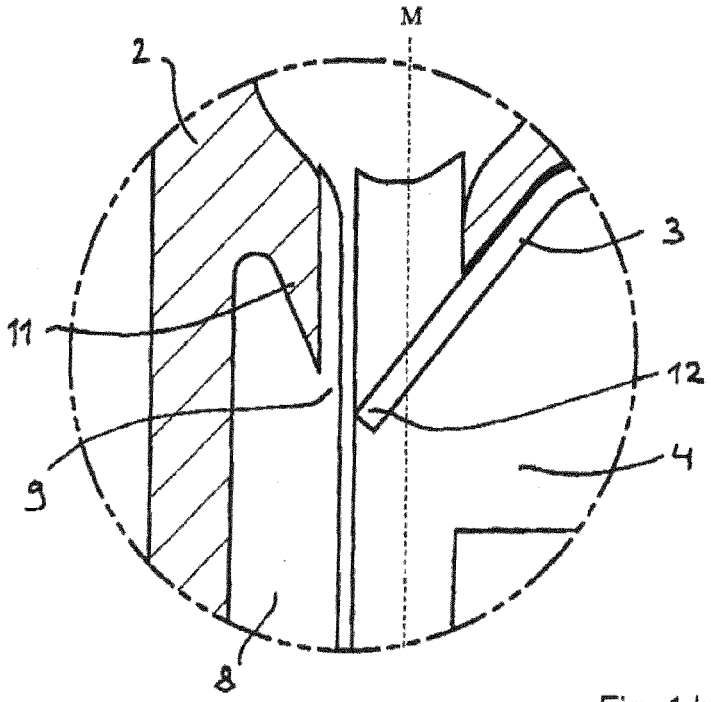
Figure 1:
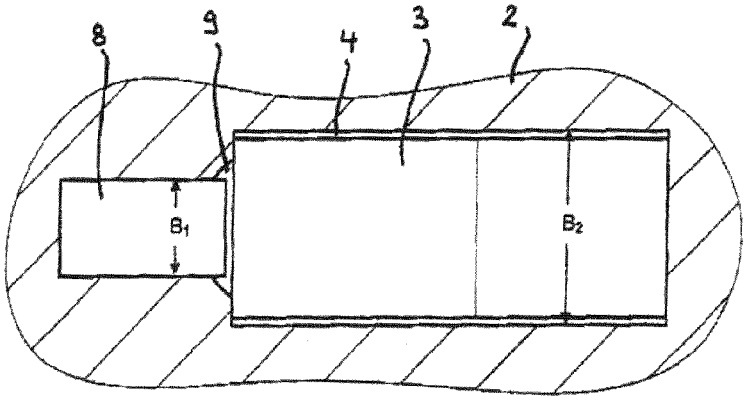
Figure 1:
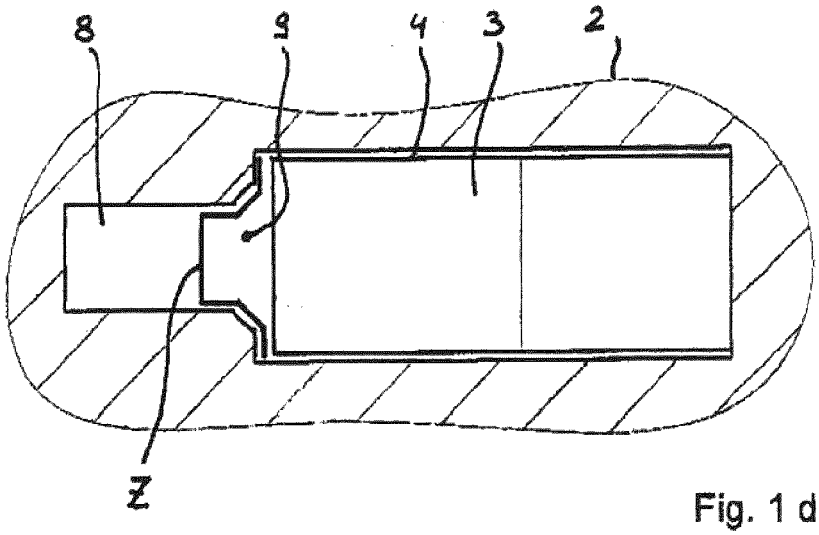
Figure 1:
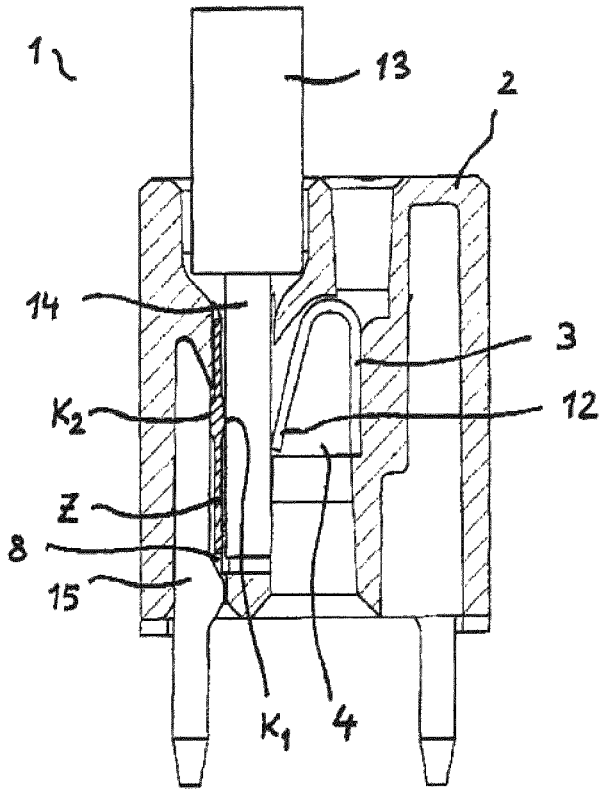
Figure 1:
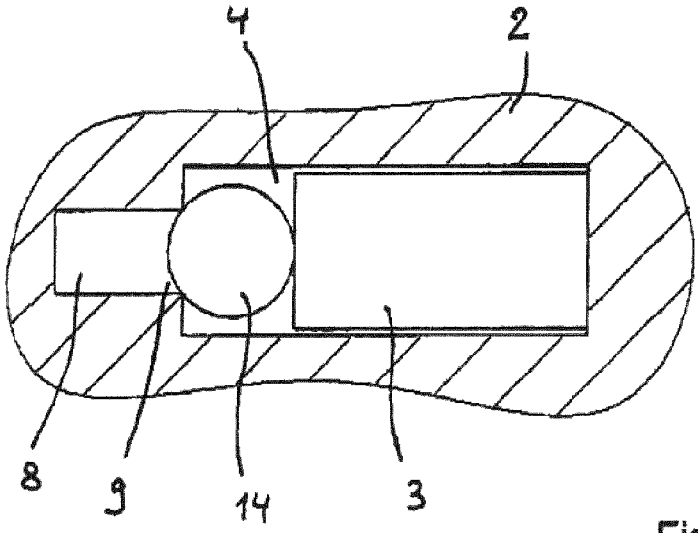

FIG. 1 *a*) shows a side section view of a first embodiment of a plug connector 1 which has an insulating material housing 2 and a spring element 3 which is arranged in a conductor connecting area 4 of the insulating material housing 2. A conductor insertion opening 6, which extends around a center axis M in the longitudinal direction, opens into the conductor connecting area 4 from a first housing face 5. A contact pin insertion opening 8 leads from the opposite, second housing face 7 into the insulating material housing 2, with an alignment parallel to the conductor insertion opening 6. As can be seen, the conductor insertion opening 6 and the contact pin insertion opening 8 extend in opposite directions to one another.

The contact pin insertion opening 8 has a passage 9 to the conductor connecting area 4 for an electrical conductor in an area above the clamping point, starting approximately from the end of the funnel-shaped taper of the conductor insertion opening 6, to below the clamping point to an end stop 10. Electrical conductors can at least partially enter this passage 9, and a contact pin can likewise enter the passage 9 from the opposite side, in order to make an electrical contact with the stripped end of the electrical conductor.

An insulating material overhang 11 is provided at the upper end of the contact pin insertion opening, in order to fix the position of a free upper end of an inserted contact pin.

FIG. 1 *b*) shows a detail of the plug connector 1 shown in FIG. 1 *a*), likewise in the form of a cross section. This clearly shows that the passage 9 is arranged outside the contour of the conductor insertion opening 6, adjacent to the conductor connecting area 4, and forms a transition between the contact pin insertion opening 8 and the conductor connecting area 4.

It is also clear that the clamping end 12 of the spring element 3 rests on a wall of the conductor insertion opening 6, without entering the passage 9, when the spring element 3 is in the unstressed limit position, without any electrical conductor inserted. The free end 12 of the spring element 3 is therefore always at a distance from the passage 9.

This is shown more clearly in FIG. 1 *c*), which shows a plan section view of the plug connector shown in FIG. 1 *a*) and FIG. 1 *b*). This clearly shows that the conductor insertion opening 6 is considerably broader than the contact pin insertion opening 8. The width of the passage 9 increases from the width $B_1$ of the contact pin insertion opening 8 toward the conductor connecting area 4 and the conductor insertion opening 6, which is arranged above it. The maximum width of the passage 9 is in this case less than the width $B_2$ of the conductor connecting area 4. This leads to the free clamping end 12 of the spring element 3 abutting against the wall of the conductor connecting area 4 and of the conductor insertion opening 6 which merges into it.

FIG. 1 *d*) shows one embodiment of the plug connector as shown in FIG. 1 *a*) with an intermediate wall Z. It is clear that the intermediate wall Z can be moved into the passage 9 and has stops on its side edges, which interact with the lateral walls, adjacent to the passage 9, of the conductor connecting area 4 to form a stop such that the intermediate wall Z cannot enter the contact pin insertion opening 8 any further when the stops make contact on the lateral wall.

In the illustrated embodiment or another embodiment, for example one that can pivot or is mounted such that it can be moved in guides in the contact pin insertion opening, intermediate walls can be used not only in conjunction with the type of plug connector shown in FIG. 1 *a*) but can be used for all feasible embodiments of plug connectors with a passage in the contact pin insertion opening and a reduced contact pin insertion opening width. The intermediate wall Z results in better guidance of the stripped ends of electrical conductors, preferably into a conductor holding pocket in the lower end of the conductor connecting area 4, preventing individual wires from undesirably becoming unwound, and presenting individual wires of multiwire flexible electrical conductors from entering well into the contact pin insertion opening.

FIG. 1 *e*) shows a side section view of the plug connector 1 with an intermediate wall Z. It is clear that the intermediate wall Z enters the passage 9 and is placed between the stripped end 14 of the electrical conductor 13 and the contact pin 15. By way of example, the intermediate wall Z has defined contact areas $K_1$ and $K_2$ for making contact with the stripped end 14 of the electrical conductor 13 on one side, and with the contact pin 15 on the other side. The contact areas K) and $K_2$ are in the form of protrusions and ensure that the contact force of the spring element 3 is concentrated on the reduced contact areas, therefore ensuring an improvement in the contact reliability and the current transfer.

FIG. 1 *f*) shows a plan section view of a modified plug connector 1 as shown in FIG. 1 *a*), in which the passage 9 has a constant passage width, B. The passage then merges into the broader conductor connecting area 4 with an abrupt change in width.

Figure 2:
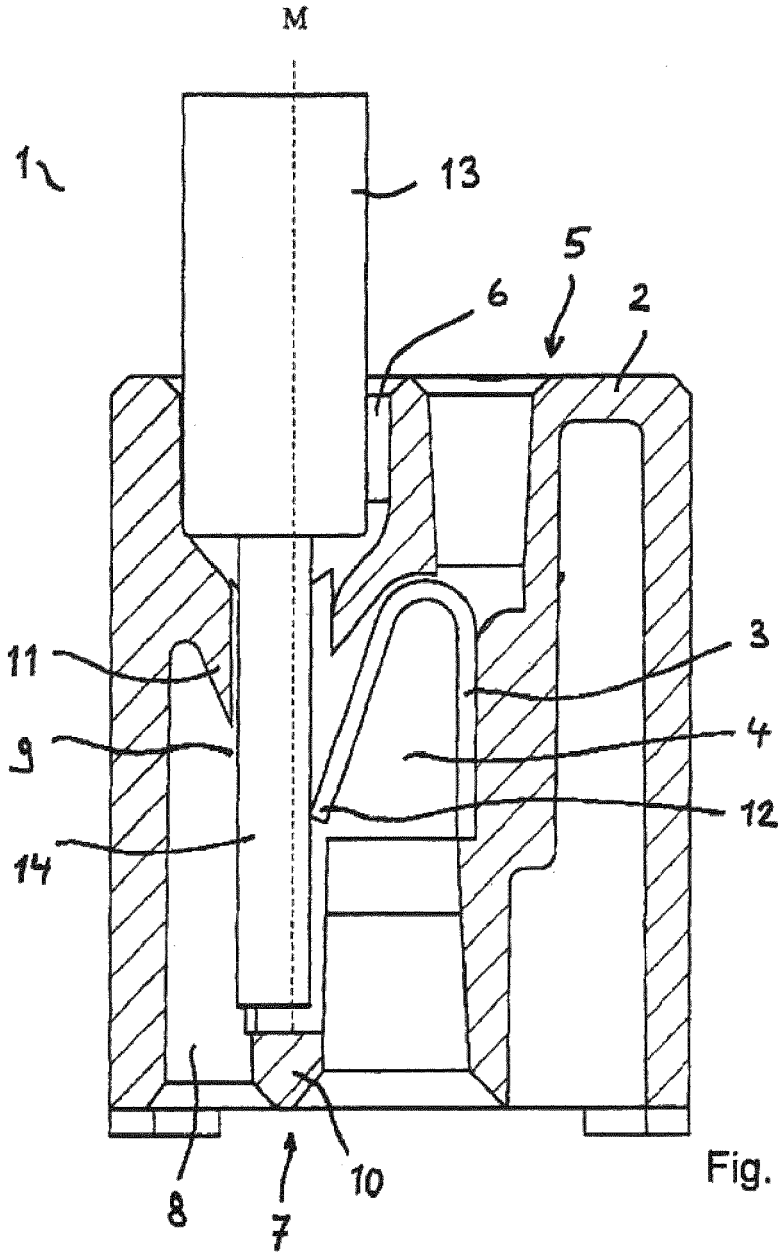
FIG. 2 *a*) shows a side section view of the plug connector shown in FIG. 1 *a*) with an inserted conductor.
Figure 2:
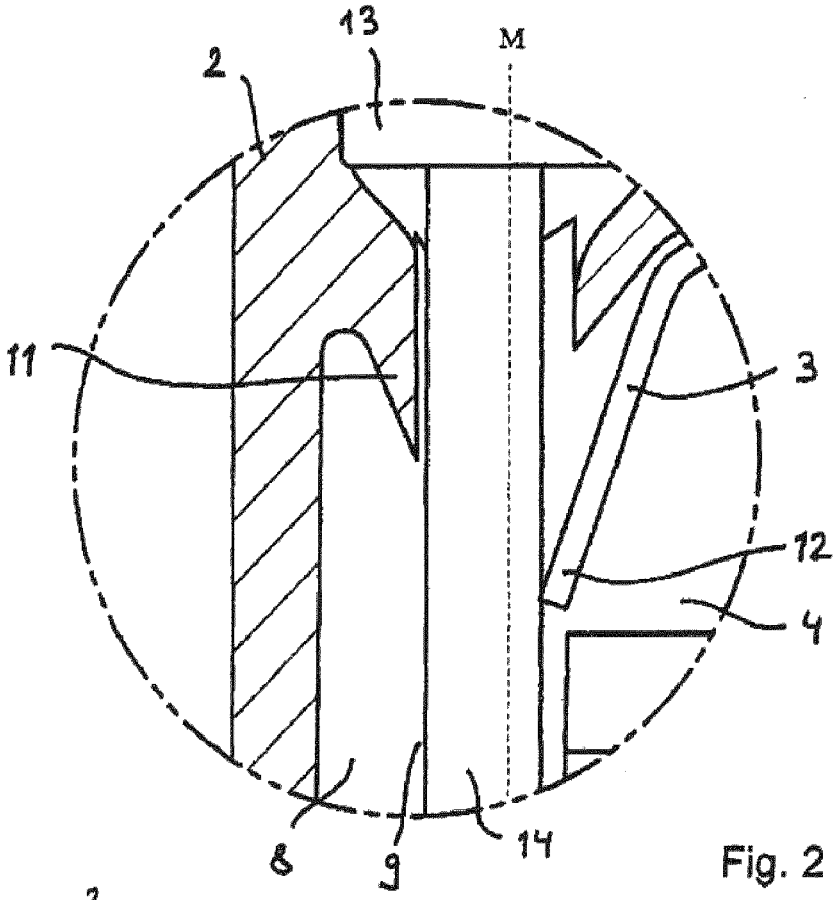
Figure 2:
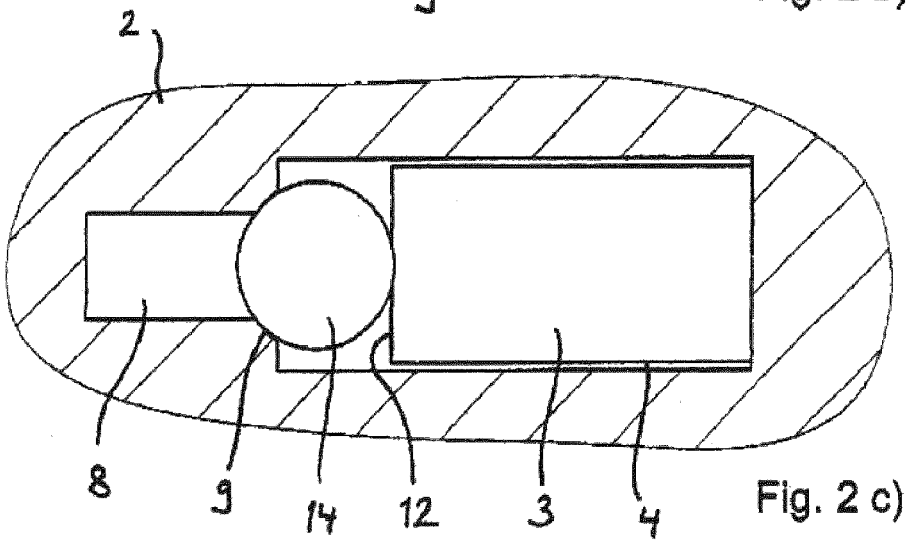

FIG. 2 *a*) shows a cross-sectional view of the plug connector 1 shown in FIG. 1 *a*), with an inserted electrical conductor 13, whose stripped free end 14 projects into the conductor connecting area 4. It is clear that the free clamping end 12 of the spring element 3 is now moved away from the contact pin insertion opening 8. The spring force of the spring element 3 in the direction of the contact pin insertion opening 8 pushes the stripped end 14 parallel, over its entire length, into the passage 9 of the contact pin insertion opening 8. The passage width of the passage 9, which is less than the minimum permissible diameter of an electrical conductor for the specific embodiment of the plug connector 1, prevents the stripped end 14 of the electrical conductor 13 from entering further into the contact pin insertion opening 8, and blocking it such that it is no longer possible to insert a contact pin into the contact pin insertion opening 8 from the second housing face 7.

FIG. 2 *b*) shows a detail view of the plug connector shown in FIG. 2 *a*). This shows even more clearly that the electrical conductor 13 together with the stripped end 14 is pushed out of the contour of the conductor insertion opening 6 around the center axis M of the conductor insertion opening 6 into the passage 9 of the contact pin insertion opening 8 outside the conductor insertion opening 6.

FIG. 2 *c*) once again shows a plan section view of this situation. This clearly shows that a circular segment of the stripped end 14 of the electrical conductor 13 enters the passage 9 and a part of the contact pin insertion opening 8 adjacent to it, without blocking the contact pin insertion opening 8. This is because the maximum passage width of the passage 9 is less than the diameter of the stripped end 14 of the electrical conductor 13, and there is therefore a defined boundary to the chord of the circular segment.

However, it is important that the minimum passage width of the passage 9 is physically matched to the minimum permissible cross section of an electrical conductor 13 provided in each case for the plug connector 1, such that the minimum passage width is less than the minimum permissible cross section of an electrical conductor. This prevents the electrical conductor 13 from being able to completely enter the contact pin insertion opening 8, thus blocking the contact pin insertion opening 8.

Figure 3:
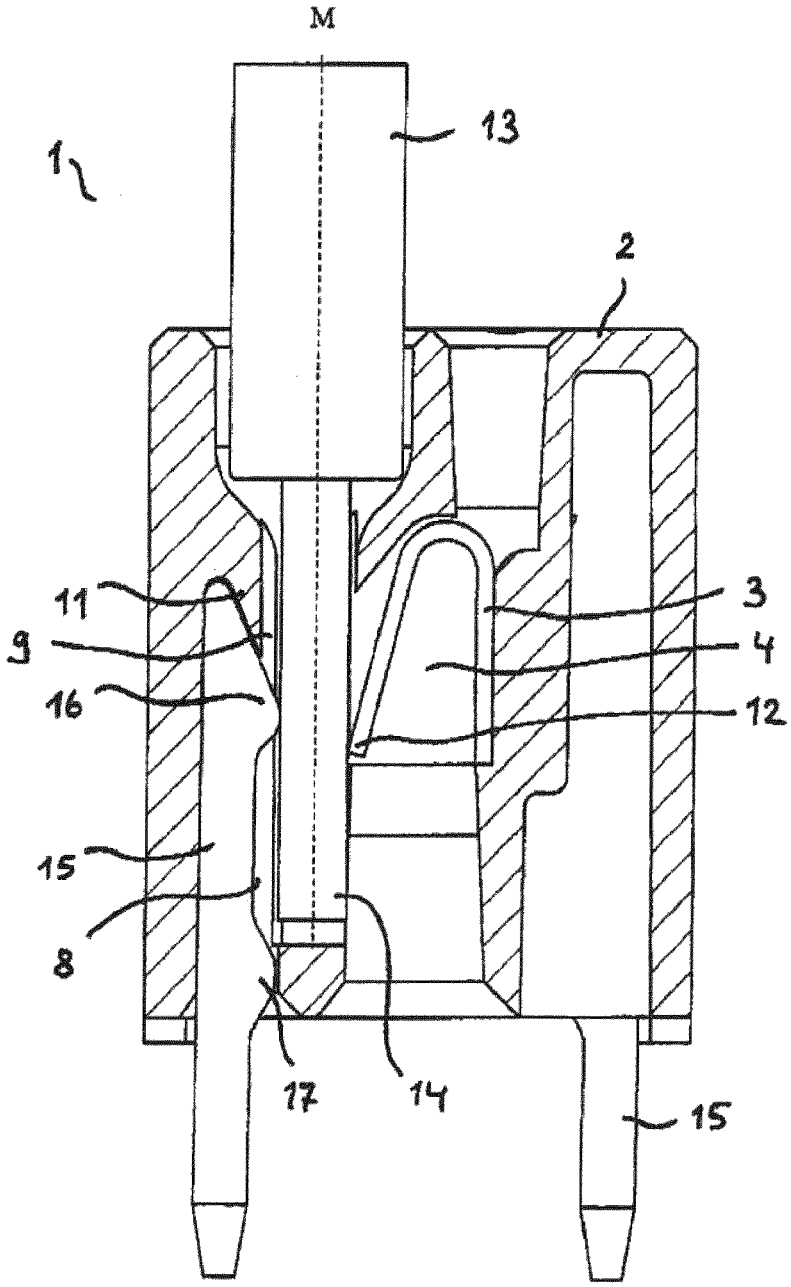
FIG. 3 *a*) shows a side section view of the plug connector shown in FIG. 1 *a*) with an inserted conductor and contact pin.
Figure 3:
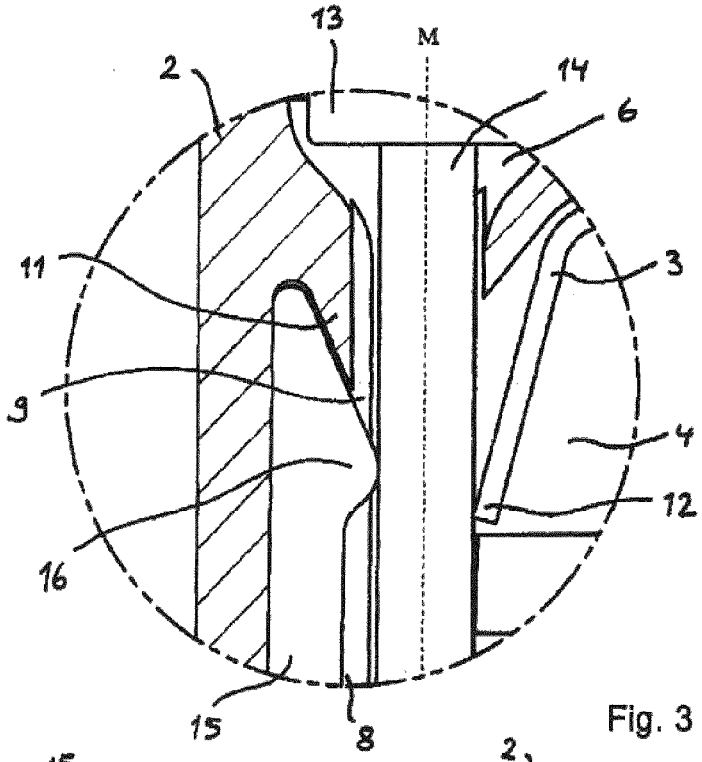
Figure 3:
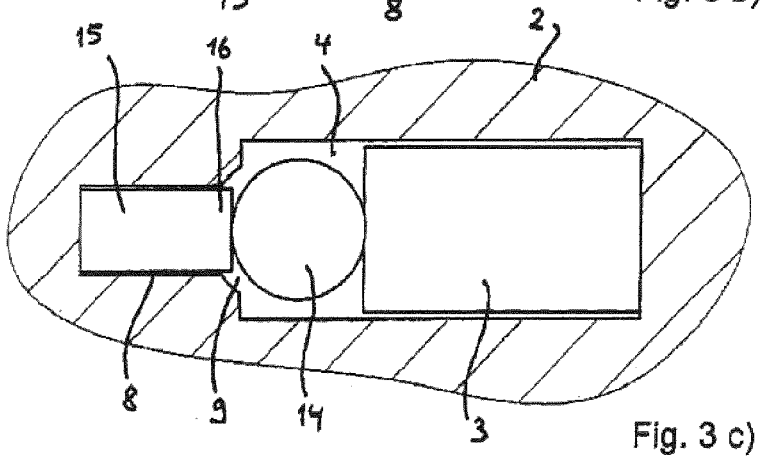

FIG. 3 *a*) shows a cross-sectional view of the plug connector 1 from FIGS. 1 *a*) and 2 *a*), with the difference that an electrical conductor 13 is inserted into a conductor insertion opening 6, and a contact pin 15 is inserted into the contact pin insertion opening 8. In the upper area, the contact pin 15 has a conductor contact section 16 in the form of a protrusion, such that the protrusion projects slightly out of the passage 9 into the conductor connecting area 4. When the contact pin 15 is inserted after an electrical conductor 13 has been inserted into the plug connector 1, as shown in FIG. 2 *a*), the stripped end 15 of the electrical conductor 13 is pushed by the contact pin 15 and its protrusion out of the passage 9, against the spring force of the spring element 3, in the direction of the conductor connecting area 4. This concentrates the clamping force of the clamping end 12 of the spring element 3 on the stripped end 14 of the electrical conductor 13 and the opposite protrusion (conductor contact section 16), seen in the force flow direction, of the contact pin 15. While the electrical conductor 13 can be moved freely and parallel in the conductor insertion opening 6 and in the passage 9, the contact pin 15 is fixed in position at its upper, conically tapering end, with the aid of the insulating material protrusion 11. A further fixing protrusion 17 in the lower area rests on the end stop 10, in order to fix the contact pin 15 and in particular to prevent it from tilting.

FIG. 3 *b*) shows a detail view of the plug connector 1 shown in FIG. 3 *a*), in the area of the clamping point. It is clear that the stripped end 14 of the electrical conductor 13 has been moved out of the passage 9 into the conductor connecting area 4 against the clamping force of the spring element 3. The figure also shows that the stripped end 14 of the electrical conductor 13 does not rest on the insulating material of the insulating material housing 2 in the area of the clamping point which is formed by the protrusion (conductor contact section 16) of the contact pin 15, as a result of which the spring force is concentrated by the stripped end 14 of the electrical conductor 13 onto the protrusion of the contact pin 15. The protrusion creates a defined small contact area, onto which the spring force of the spring element 3 is concentrated. This ensures a good electrical contact with as low a contact resistance as possible, and with as high a current carrying capability as possible.

FIG. 3 *c*) shows a plan section view of the plug connector 1 shown in FIG. 3 *a*) with an inserted electrical conductor 13 and contact pin 15. This illustration shows even more clearly how the stripped end 14 of the electrical conductor 13 is pushed by the contact pin 15 in the direction of the conductor connecting area 4, against the spring force of the spring element 3. In consequence, the stripped end 14 of the electrical conductor 13 now enters the passage 9 only with a reduced circular segment, without touching the walls of the passage 9 in the process. The spring force of the spring element 3 is thus concentrated onto the contact pin 15 through the stripped end 14, without being buffered by insulating material.

Figure 4:
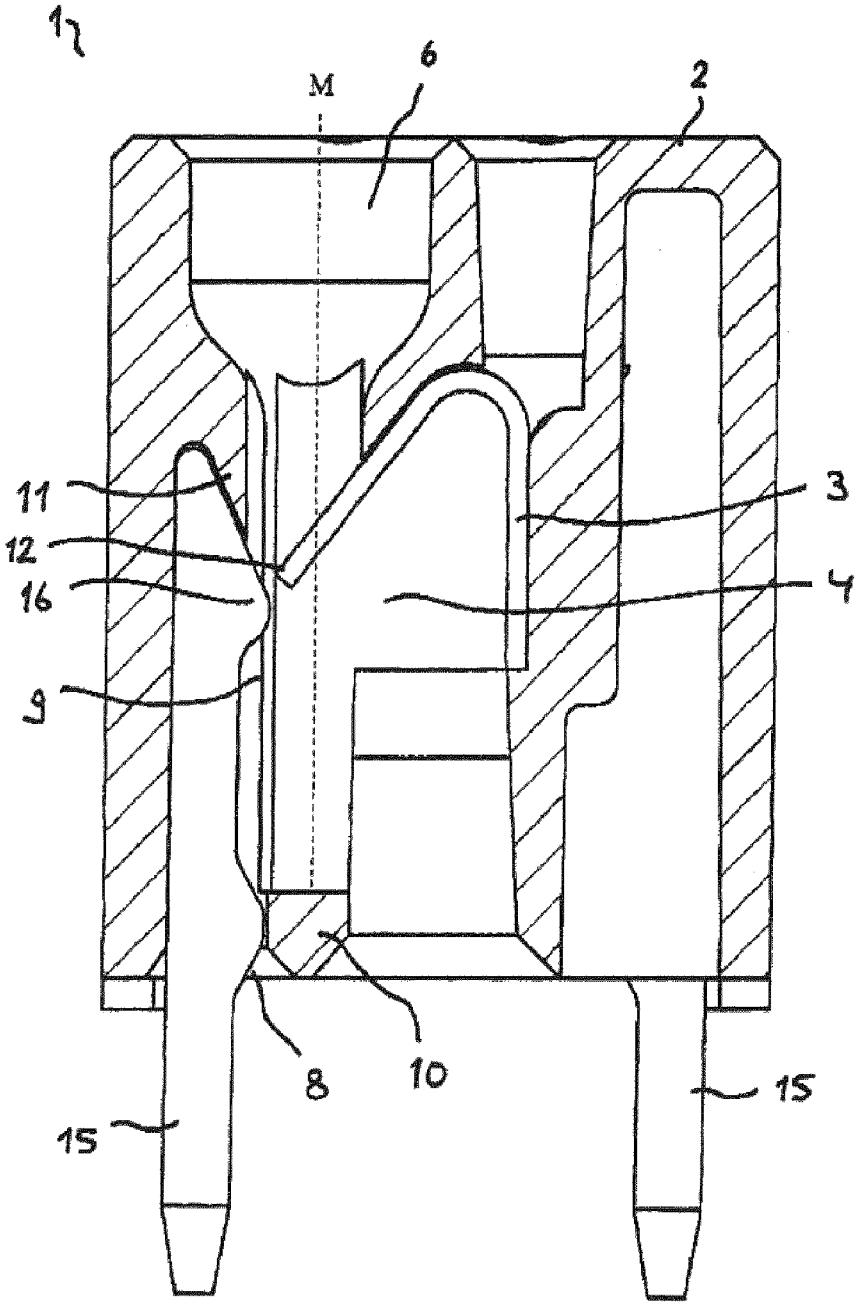
FIG. 4 *a*) shows a side section view of the plug connector shown in FIG. 1 *a*) with an inserted contact pin.
Figure 4:
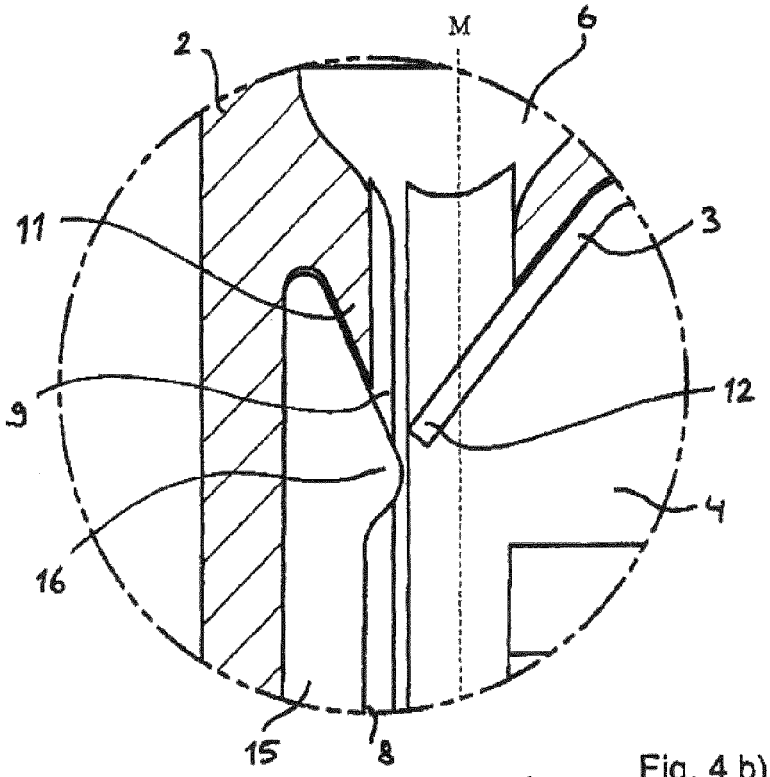
Figure 4:
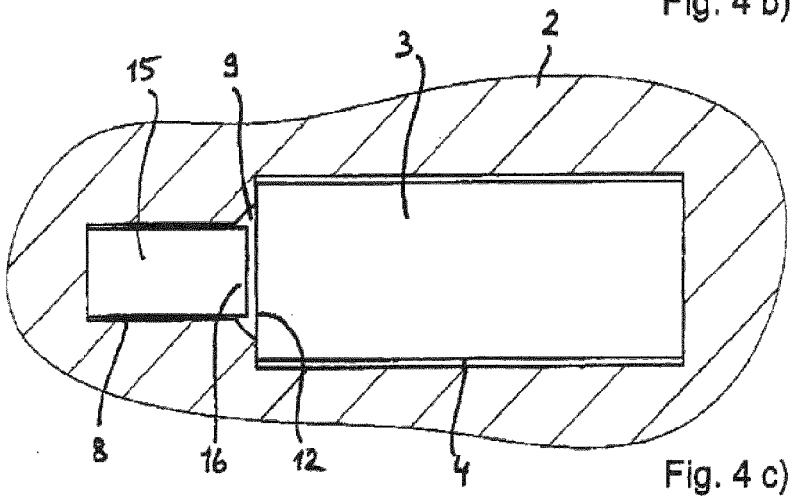

FIG. 4 *a*) shows a cross-sectional view of the plug connector 1 shown in FIGS. 1) to 3). In contrast to the above illustrations, only one contact pin 15 is now inserted into the contact pin insertion opening. In this case, it is clear that the protrusion of the contact pin 15 projects through the passage 9 into the conductor connecting area 4. The contact plane of the protrusion, which contact plane extends, for example, parallel to the center axis M of the conductor insertion opening 6, is in this case directly adjacent to the contact plane of the free clamping end 12 of the spring element 3 which accommodates the latter in the unstressed position when no electrical conductor 13 is inserted. In consequence, the spring element 3 is moved to the maximum possible extent by the stripped end 14 of the electrical conductor 13 when an electrical conductor 13 is inserted. This results in an optimized clamping force of the spring element 3, which the spring element 3 exerts via the clamping end 12 on the electrical conductor 13 and the protrusion of the contact pin 15.

This situation becomes clearer with reference to the detail view shown in FIG. 4 *b*) and in particular the plan section view shown in FIG. 4 *c*). While the free clamping end 12 of the spring element 3 abuts against the lateral wall of the conductor connecting area 4, the protrusion of the contact pin 15 projects into the passage 9, leaving a small gap at the clamping end 12.

Figure 5:
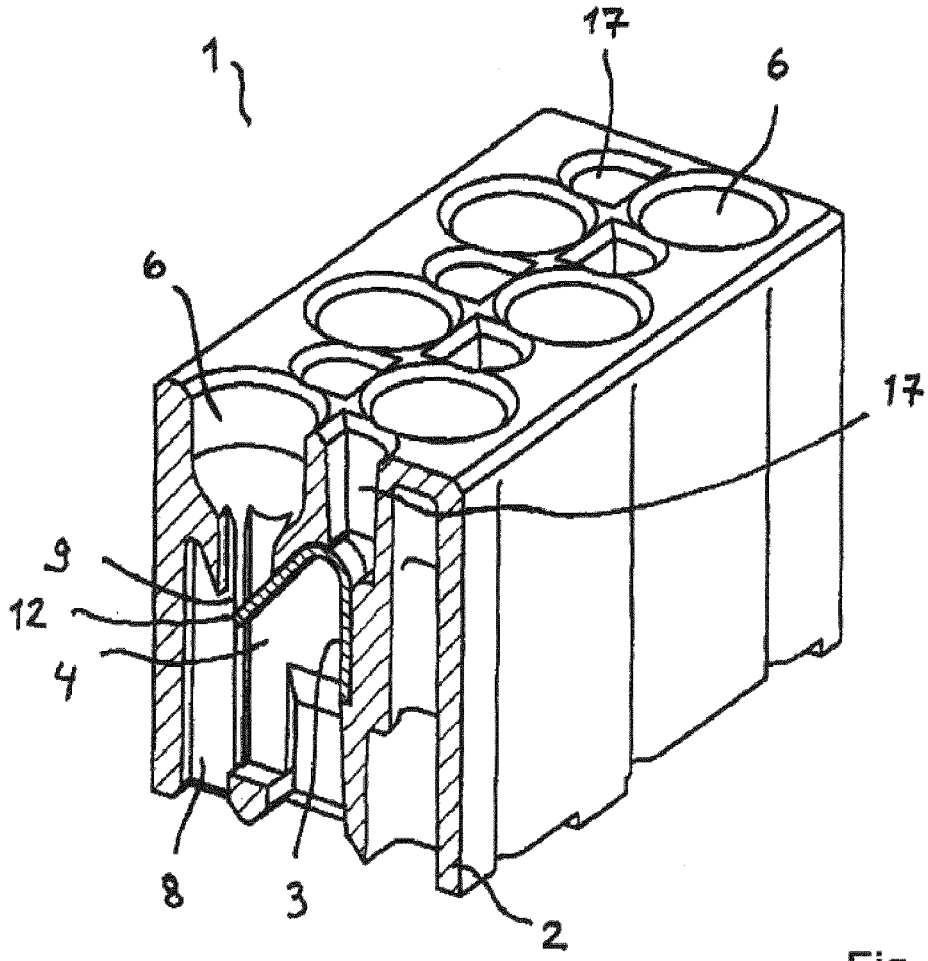
FIG. 5) shows a perspective section view of the plug connector shown in FIGS. 1) to 4)

FIG. 5) shows a perspective section view of the plug connector 1 described above. This shows, in particular, the funnel-shaped configuration of the conductor insertion openings 6, which merge into a conductor connecting area 4. In this case, the funnel-shaped conductor insertion opening 6 ends in a square contour with a width which corresponds to the width of the conductor connecting area 4. Adjacent to this, the width decreases toward the contact pin insertion opening 8, with a tapering passage 9 being provided adjacent to the lateral wall of the conductor connecting area 4 against which the clamping end 12 of the spring element 3 abuts.

As can also be seen, the plug connector 1 has conductor insertion openings 6, with an associated conductor connecting area 4 and spring element 3, alternately and offset in mirror-image form with respect to one another, in order in this way to allow as great a number of electrical conductors and associated contact pins as possible to be connected in as small an area as possible.

A test opening 17, which is open toward the spring element 3 and by means of which the voltage potential on the respective spring element 3 can be measured, is located in each case alongside a conductor insertion opening.

Figure 6:
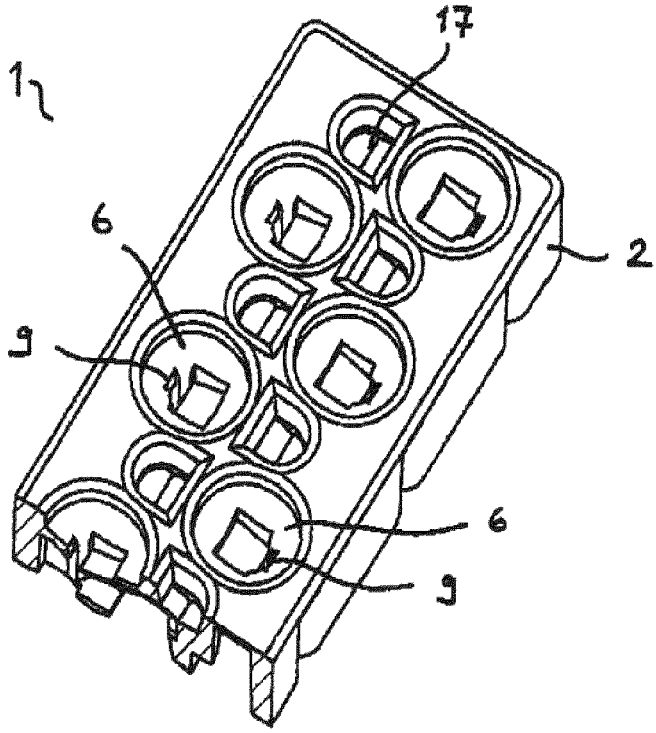
FIG. 6) shows a perspective plan view of the plug connector shown in FIG. 5)

FIG. 6) shows a perspective view of the plug connector 1, in the form of a plan section through the upper part of the insulating material housing 2. This shows even more clearly that the passage 9 is arranged away from the (for example symmetrical) contour of the square area of the conductor insertion opening 6, in order to allow movement of the electrical conductor over an axial length around the clamping point, partially into the passage 9.

The figure also shows the reduced passage width of the passage 9, thus preventing the contact pin insertion opening 8 from being blocked by the stripped end 14 of an electrical conductor 13.

Figure 7:
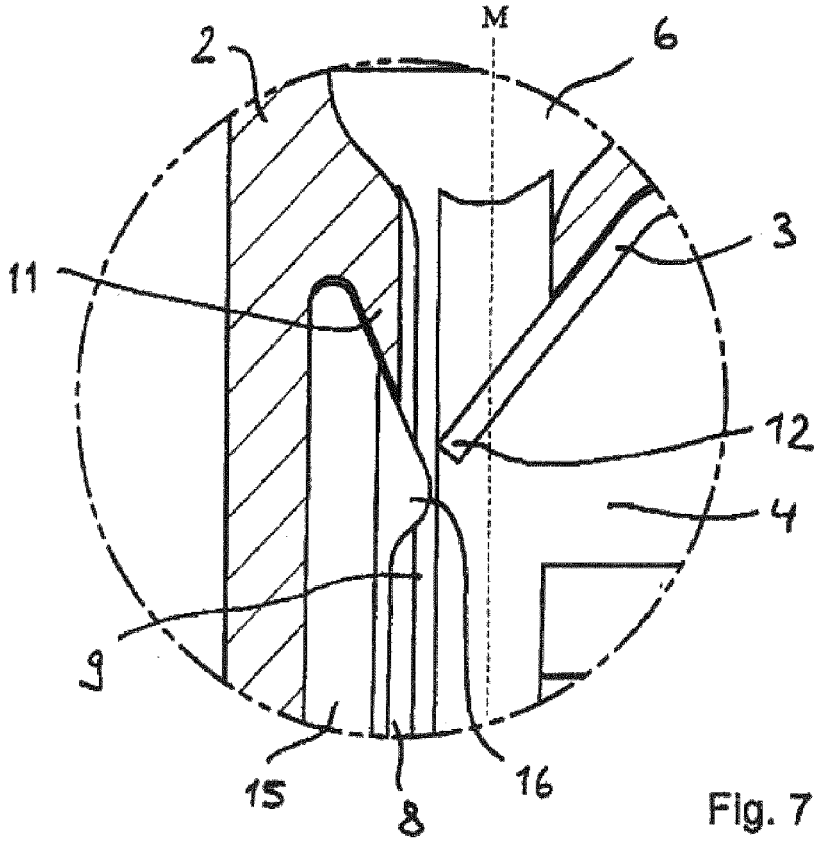
FIG. 7 *a*) shows a detail view of the clamping area of a second embodiment of a plug connector with a contact pin inserted.
Figure 7:
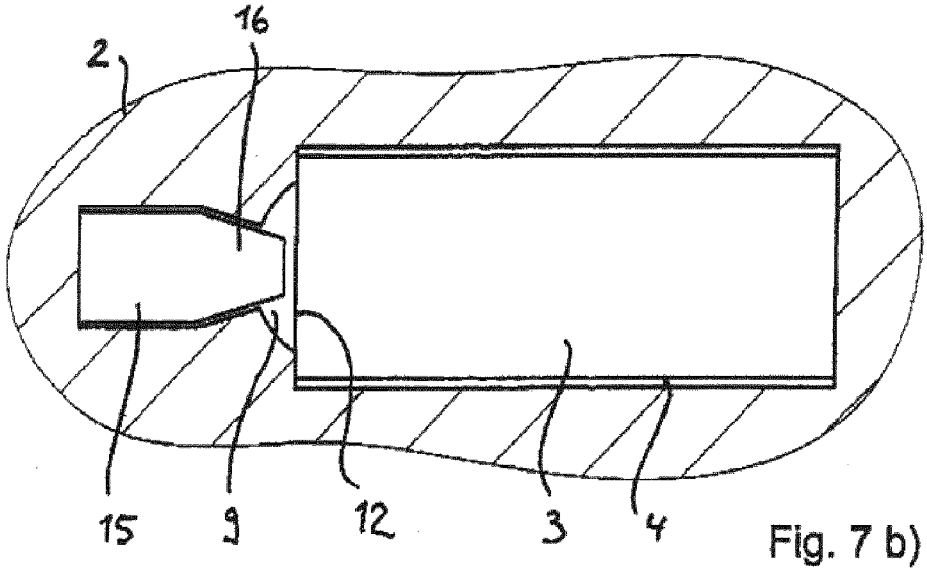

FIG. 7 *a*) shows a detail view of a second embodiment of a plug connector 1. In this case as well, a conductor contact section 16 in the form of a protrusion 16 of the contact pin 15 projects into the passage 9 of the conductor insertion opening 8. However, the protrusion has a narrower width than the adjacent center piece of the contact pin 15 and preferably tapers conically, as is illustrated in the plan section view in FIG. 7 *b*). In contrast to the embodiment described above, the contact pin insertion opening 8 tapers in the direction of the conductor connecting area 4 to the area in which the passage 9 broadens again. In the illustrated exemplary embodiment, that part of the passage 9 which tapers from the contact pin insertion opening 8 to the conductor connecting area 4 tapers conically, while that part of the passage 9 which is adjacent to it has a cross section which broadens in the form of part of a circle toward the conductor connecting area 4.

As can be seen from FIG. 7 *b*), the protrusion is likewise designed such that it tapers conically, corresponding to the conically tapering part of the passage 9.

Figure 8:
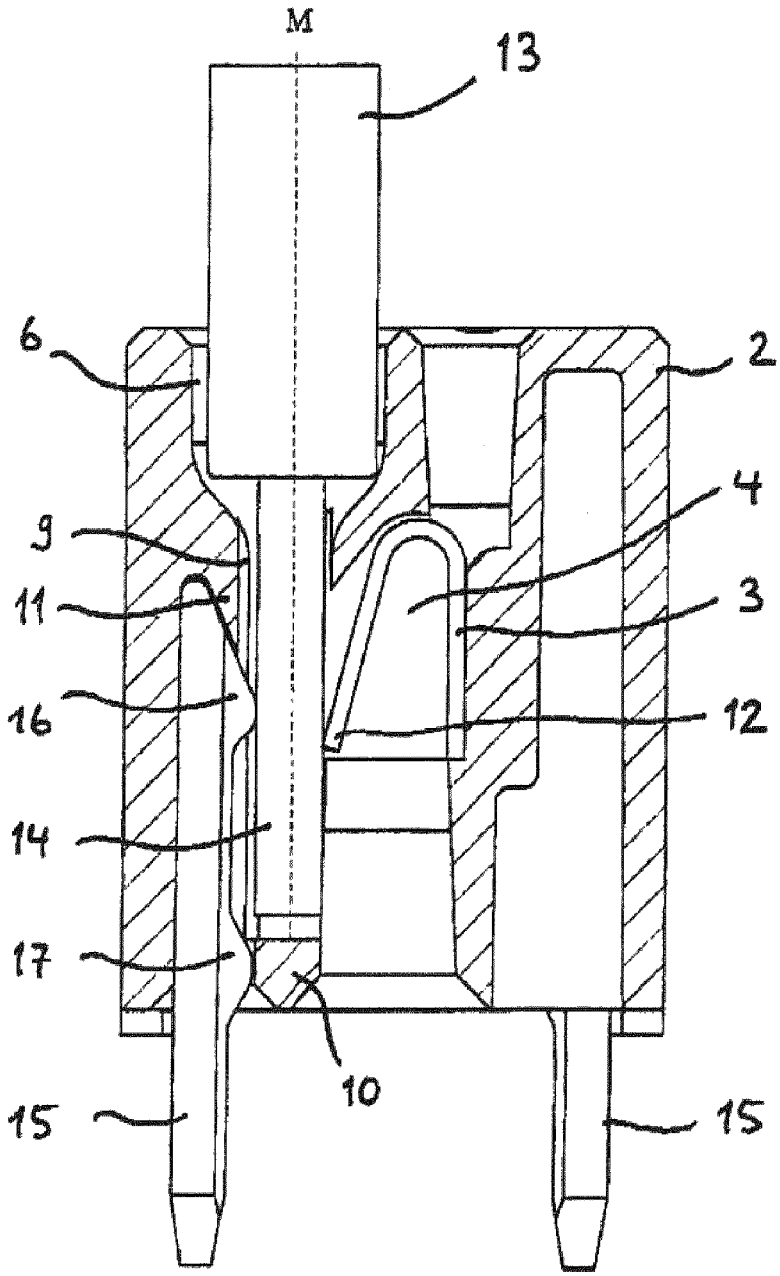
FIG. 8 *a*) shows a side section view of the second embodiment of the plug connector with an inserted conductor and contact pin.
Figure 8:
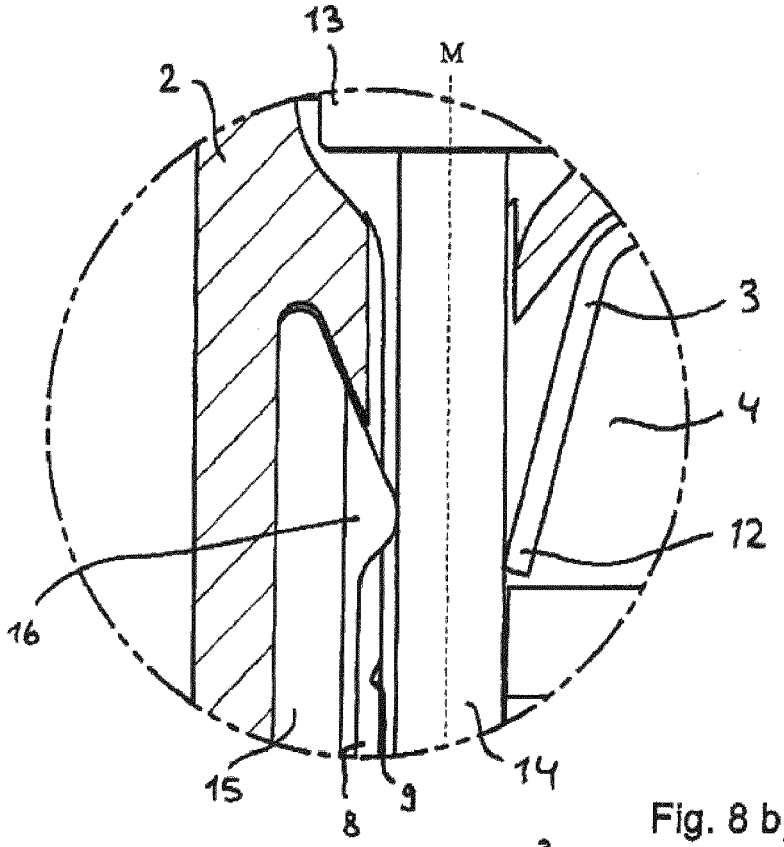
Figure 8:
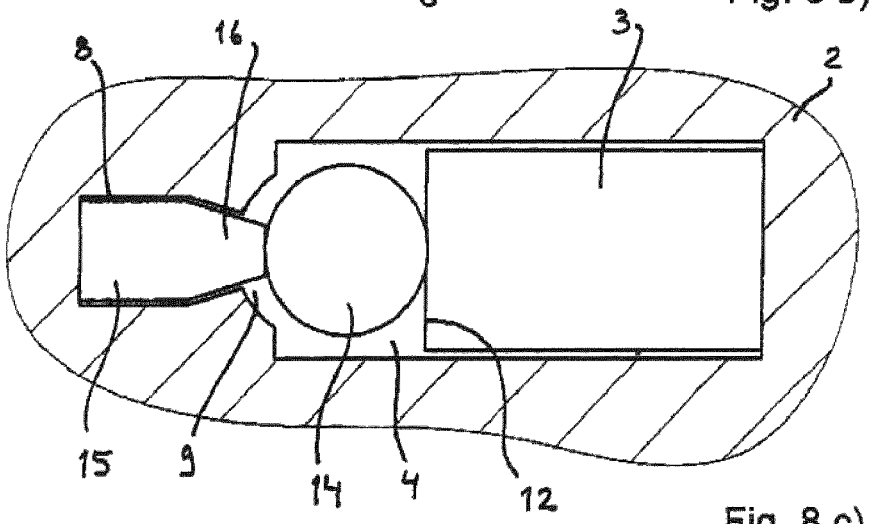

FIG. 8 *a*) shows a cross-sectional view of the second embodiment of the plug connector 1 with an inserted electrical conductor 13 and contact pin 15. It is clear in this case that the protrusion, which tapers toward the free end, moves the stripped end 14 of the electrical conductor 13 against the spring force of the spring element 3 out of the passage 9 into the conductor connecting area 4. This results in the electrical conductor 13 being moved parallel about its longitudinal axis out of the passage 9 into the conductor insertion opening 6.

That part of the passage 9 which tapers conically and runs from the contact pin insertion opening 8 in the direction of the conductor connecting area 4 has the advantage that the passage width of the passage 9 can be reduced further without having to excessively reduce the cross section of the contact pin 15.

FIG. 8 *b*) shows a detail view of the plug connector 1 shown in FIG. 8 *a*) with an inserted electrical conductor 13 and contact pin 15. It is clear from this and from the plan section view shown in FIG. 8 *c*) how the stripped end 14 of the electrical conductor is pushed, with the aid of the conically tapering protrusion of the contact pin 15, at least partially out of the passage 9, into the conductor connecting area 4, against the spring force of the spring element 3. In this case, the clamping force is concentrated onto the narrow contact end of the conically tapering protrusion (conductor contact section 16), thus resulting in improved current transfer.

Figure 9:
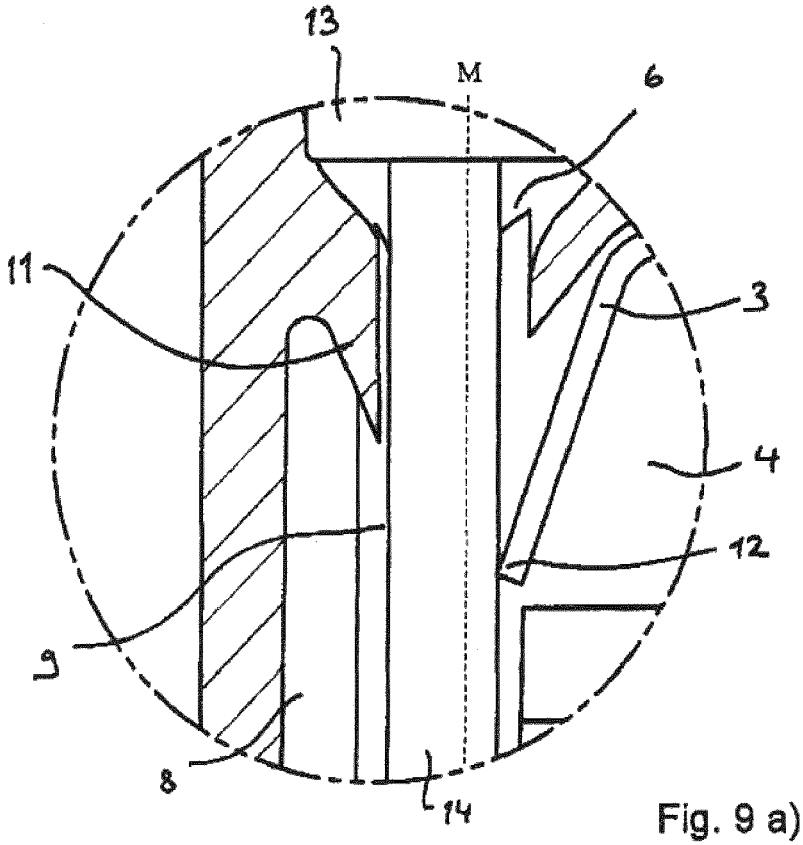
FIG. 9 *a*) shows a detail view of the plug connector shown in FIG. 8 *a*) with a conductor inserted.
Figure 9:
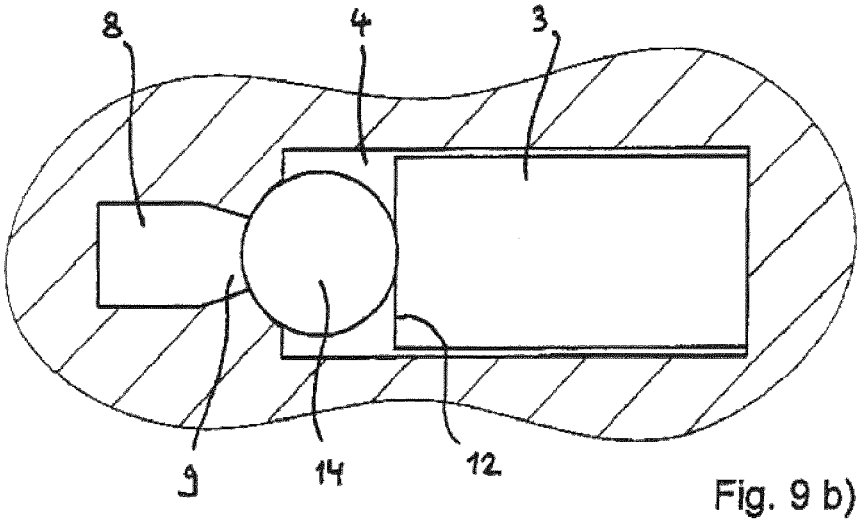

FIG. 9 *a*) shows the plug connector 1 shown in FIG. 8 *a*) with an inserted electrical conductor 13, without a contact pin. This clearly shows how a segment of the electrical conductor 13 is moved over its axial length partially into the passage 9 of the conductor insertion opening 8. The movement takes place approximately parallel to the conductor axis or center axis M of the conductor insertion opening 6, as a result of the spring force of the spring element 3.

FIG. 9 *b*) shows this better, using a plan section view. The conically tapering contour, which is then in the form of part of a circle, of the passage 9 is also clearly shown here.

FIGS. 10) to 18) show various embodiments of contact pins 15, in the form of a plan view, side view, rear-face view and perspective illustration.

In the embodiment illustrated in FIG. 10), the protrusion 16 which forms the conductor contact section 16 has the same width as the contact pin 15 itself. This also applies to the fixing protrusion 17 in the lower area.

The contact pin 15 tapers slightly conically in the lower end in order to allow it to be inserted into a hole in the printed circuit board, and to be soldered there.

The upper free end of the contact pin 15 likewise tapers conically and is rounded at the upper end. This allows an electrical conductor 13, which projects partially into the contact pin insertion opening 8, to be forced out of the contact pin insertion opening 8.

FIG. 11) shows the embodiment of the contact pin 15, as already described above in conjunction with the second embodiment of the plug connector 1, with a protrusion (conductor contact section 16) which tapers conically toward the free contact end. The fixing protrusion 17 is also correspondingly shaped such that it tapers conically.

FIG. 12) shows an embodiment, comparable to that in FIG. 10), of the contact pin 15, in which the fixing protrusion 17 is not rounded but is rectangular. In some circumstances, this improves the jamming of the contact pin 15 in the insulating material of the insulating material housing 2.

FIG. 13) shows one embodiment of a contact pin 15, in which, starting from the conically tapering free end of the contact pin 15, the protrusion corresponds over the entire length of the associated passage 9 in the insulating material housing.

FIG. 14) shows a cylindrical embodiment of a contact pin 15, which tapers conically at the upper end. For this embodiment, the passage 9 of the contact pin insertion opening 8 would likewise have to taper in the form of part of a circle toward the conductor connecting area 4.

FIG. 15) shows a likewise cylindrical embodiment of a contact pin 15, whose upper free end tapers in the form of a triangle, in cross section, for position fixing. The free uppermost end can be rounded.

FIG. 16) shows an embodiment, comparable to that shown in FIG. 15), of a contact pin 15, but with an oval cross section. This allows the narrow face to enter the passage 9 of the contact pin insertion opening 8, thus providing a clamping point for the adjacent electrical conductor 13.

FIG. 17) shows an embodiment, similar to that shown in FIG. 16), of a contact pin 15, in which the narrow edges taper conically and trapezoidally, however.

FIG. 18) shows an embodiment of a contact pin 15 in which an end which tapers in a triangular shape toward the free end is adjacent to a rectangular section. For insertion into and soldering in a printed circuit board, the contact pin 15 ends with an approximately square cross section under the rectangular section.

The symmetrical embodiments of the contact pins 15 shown in FIGS. 14) to 18) are particularly suitable for plug connectors 1 in which two or possibly more conductor connecting areas 4 are provided for one contact pin 15, with the contact pin 15 being positioned centrally between the conductor connecting areas 4, and with the conductor connecting areas 4 being used as a common contact pin 15.

The invention claimed is:

1. Plug connector comprising:

an insulating material housing which has at least one contact pin insertion opening on a first housing face for insertion of an electrically conductive contact pin and at least one conductor insertion opening on a second opposite housing face for the insertion of stripped end of an electrical conductor, the conductor insertion opening having an alignment parallel to the conductor insertion opening, wherein a pair comprising a contact pin insertion opening and a conductor insertion opening are each associated with one common conductor connecting area, the conductor insertion opening opens in the conductor connecting area and the contact pin insertion opening has a passage to the conductor connecting area, and said pair having in each case one spring force terminal connection in an associated conductor connecting area with a spring element which has a clamping section that can be moved by spring force transversely with respect to a direction of said pair comprising a contact pin insertion opening and a conductor insertion opening, wherein, when a stripped end of an electrical conductor is inserted into the conductor insertion opening, the stripped end is pushed in the direction of the contact pin insertion opening, wherein the at least one contact pin insertion opening has a width ($B_1$) of the passage over a length in its extent direction, which is aligned from the first housing face to the second housing face, at the least in an area above the clamping section in the direction of the second housing face and under the clamping section in the direction of the first housing face, which width ($B_1$) is less than a width ($B_2$) between the mutually opposite side walls of the conductor connecting area adjacent to the transition to the contact pin insertion opening.

2. Plug connector according to claim 1, wherein the width ($B_1$) of the passage of the contact pin insertion direction, which passage leads to the conductor connecting area, is matched to a minimum permissible nominal cross section of the electrical conductor, which nominal cross section is defined for the plug connector, wherein the stripped end enters the passage, leaving a free space for a contact pin with a part of its cross section, when no contact pin is inserted, and wherein the passage is matched to the contact pin such that a conductor contact section facing the conductor connecting area of the contact pin enters the passage, and in the process the stripped end of the electrical conductor makes contact with the conductor contact section and can be moved against the spring force of the associated spring element.

3. Plug connector according to claim 1, wherein the contact pin insertion opening has a passage width which decreases from the respective conductor connecting area in the direction of the contact pin insertion opening, in the at least one passage to the respectively associated at least one conductor connecting area.

4. Plug connector according to claim 3, wherein the contact pin insertion opening has a cross section which tapers in the form of part of a circle in the passage adjacent to the conductor connecting area.

5. Plug connector according to claim 4, wherein the radius of the passage, whose cross section is in the form of part of a circle, is matched to a defined nominal cross section of an electrical conductor for the plug connector, and corresponds thereto.

6. Plug connector according to claim 1, wherein the passage of the at least one contact pin insertion opening tapers from the contact pin insertion opening in the direction of the conductor connecting area.

7. Plug connector according to claim 1, wherein a contact pin insertion opening is associated with two mutually opposite conductor insertion openings which open into a respective conductor connecting area, wherein the associated contact pin insertion opening has two mutually opposite passages, which open into a respective conductor connecting area.

8. Plug connector according to claim 1, wherein, in the area of the at least one contact pin insertion opening, the insulating material housing in each case has an insulating material overhang for fixing the position of the head end of a contact pin which has been inserted into the contact pin insertion opening.

9. Plug connector according to claim 1, wherein, in the unstressed state when no electrical conductor has been inserted into the associated conductor insertion opening, the clamping end of the spring element does not project into the contact pin insertion opening.

10. Plug connector according to claim 9, wherein, in the unstressed state when no electrical conductor has been inserted into the associated conductor insertion opening, the clamping end of the spring element abuts against a lateral wall of the conductor connecting area adjacent to the contact pin insertion opening.

11. Plug connector according to claim 1, further comprising an electrically conductive intermediate wall (Z) which can move in the passage for positioning between the contact pin and the clamping section of the spring element.

12. Plug connector according to claim 1, wherein the intermediate wall (Z) is mounted in the insulating material housing such that it can pivot into the passage.

13. Plug connector according to claim 1, wherein the intermediate wall (Z) is mounted such that it can be moved in the direction of the conductor connecting area by guides which are formed in the contact pin insertion opening.

14. Plug connector according to claim 1, wherein the intermediate wall (Z) has stops which interact with lateral walls of the conductor connecting area, which are adjacent to the passage, and form a stop in order to limit the movement of the intermediate wall (Z) into the contact pin insertion opening.

15. A plug connector comprising:

an insulating material housing having a conductor insertion opening on a first face and a contact pin insertion opening on a second face opposite said first face, said insulating material housing further having a conductor connecting area within the housing, the conductor insertion opening extending around a center axis in a longitudinal direction and opening into the conductor connecting area from said first face and the contact pin insertion opening leading from the second opposite face into the insulating material housing with an alignment parallel to the conductor insertion opening, the conductor insertion opening and the contact pin insertion opening extending in opposite directions to one another, the conductor insertion opening being considerably broader than the contact pin insertion opening;

a spring element arranged in the conductor connecting area of the insulating material housing and positioned to clamp an electrical conductor inserted into the conductor insertion opening at a clamping point within the conductor connecting area;

the contact pin insertion opening having a passage to the conductor connecting area for an electrical conductor in an area above the clamping point, the passage having a shape such that electrical conductors can at least partially enter the passage and a contact pin can also enter the passage from an opposite side in order to make an electrical contact with the stripped end of the electrical conductor, the passage being arranged outside a contour of the conductor insertion opening and adjacent to the conductor connecting area to form a transition between the contact pin insertion opening and the conductor connecting area, a clamping end of the spring element rests on a wall of the conductor insertion opening without entering the passage when the spring element is in the unstressed limit position without any electrical conductor inserted so that the clamping end of the spring element is always at a distance from the passage;

whereby a stripped end of an electrical conductor is prevented from blocking the contact pin insertion opening when no contact pin is inserted and a contact pin, shaped such that it can be plugged into the contact pin insertion opening, with the stripped end of the electrical conductor being moved against the spring force, and, in the process, the stripped end of the electrical conductor makes contact with contact pin in the conductor contact section.

16. The plug connector of claim 15, wherein a width of the passage increases from the width $B_1$ of the contact pin insertion opening toward the conductor connecting area and the conductor insertion opening, a maximum width of the passage being less than a width $B_2$ of the conductor connecting area so that the clamping end of the spring element abuts against a wall of the conductor connecting area and of the conductor insertion opening which merges into it.

17. The plug connector of claim 16, wherein the passage has a funnel-shaped taper, starting approximately from an end of the conductor insertion opening to below the clamping point to an end stop.

* * * * *